US012253297B2

(12) United States Patent
Song

(10) Patent No.: US 12,253,297 B2
(45) Date of Patent: Mar. 18, 2025

(54) HOME APPLIANCE

(71) Applicant: LG Electronics Inc., Seoul (KR)

(72) Inventor: Seongmin Song, Seoul (KR)

(73) Assignee: LG Electronics Inc., Seoul (KR)

( * ) Notice: Subject to any disclaimer, the term of this patent is extended or adjusted under 35 U.S.C. 154(b) by 183 days.

(21) Appl. No.: 17/987,538

(22) Filed: Nov. 15, 2022

(65) Prior Publication Data

US 2023/0152029 A1 May 18, 2023

(30) Foreign Application Priority Data

Nov. 16, 2021 (KR) ..... 10-2021-0158030

(51) Int. Cl.
*F25D 23/02* (2006.01)
*F25D 27/00* (2006.01)

(52) U.S. Cl.
CPC ..... *F25D 23/028* (2013.01); *F25D 27/00* (2013.01); *F25D 2400/18* (2013.01)

(58) Field of Classification Search
None
See application file for complete search history.

(56) References Cited

U.S. PATENT DOCUMENTS 5,603,557 A * 2/1997 Marks ..... A47L 15/4265 312/265.6
7,178,886 B2 * 2/2007 Hightower ..... F16B 12/26 312/265.5
8,366,221 B2 * 2/2013 Kim ..... F25D 23/02 312/405
8,789,900 B2 * 7/2014 Laible ..... A47B 96/20 312/204
9,339,993 B2 * 5/2016 Cites ..... B32B 3/04
11,959,691 B2 * 4/2024 Kwon ..... F25D 23/02
2007/0188059 A1 * 8/2007 Davis ..... F24C 15/045 312/265.6
2009/0045705 A1 2/2009 Laible et al.
(Continued)

FOREIGN PATENT DOCUMENTS

CN 103250018 8/2013
CN 108826813 A * 11/2018
(Continued)

OTHER PUBLICATIONS

Extended European Search Report in European Appln. No. 22207781.0, Apr. 3, 2023, 10 pages.

*Primary Examiner* — Hanh V Tran
(74) *Attorney, Agent, or Firm* — Fish & Richardson P.C.

(57) ABSTRACT

An appliance includes a cabinet in which a storage space is defined and a door configured to open and close the storage space. The door includes a door body and a panel assembly mounted on a front surface of the door body. The panel assembly includes a panel which is configured to define a front surface of the door and through which light is transmitted, a lighting device configured to allow the panel to shine with a set color, a back cover configured to define a rear surface of the panel assembly, and a panel holder configured to fix the panel assembly to the door body. The panel holder includes a base fixed inside the panel assembly and a holder protrusion protruding from the base to pass through the back cover and coupled to the door body when the panel assembly is mounted.

20 Claims, 29 Drawing Sheets

(56) References Cited

U.S. PATENT DOCUMENTS

| | | | | |
|---|---|---|---|---|
| 2010/0313592 | A1* | 12/2010 | Pae | F25D 23/02 62/449 |
| 2012/0169196 | A1* | 7/2012 | Marchetti | E06B 5/006 312/265.6 |
| 2019/0053685 | A1* | 2/2019 | Chwalibog | A47L 15/4293 |
| 2020/0326119 | A1* | 10/2020 | Lee | F25D 23/028 |
| 2021/0318061 | A1 | 10/2021 | Lee et al. | |
| 2023/0018403 | A1* | 1/2023 | Park | F25D 23/02 |

FOREIGN PATENT DOCUMENTS

| | | |
|---|---|---|
| EP | 3809072 | 4/2021 |
| KR | 10-2018-0067382 | 6/2018 |
| WO | WO 2021/172947 | 9/2021 |

* cited by examiner

HOME APPLIANCE

CROSS-REFERENCE TO RELATED APPLICATIONS

The present application claims priority under 35 U.S.C, 119 and 35 U.S.C. 365 to Korean Patent Application No. 10-2021-0158030, filed on Nov. 16, 2021, which is hereby incorporated by reference in its entirety.

BACKGROUND

The present disclosure relates to a home appliance.

In general, home appliances are disposed in an indoor space and may be disposed to be harmonized with the surrounding space. In addition, to further improve the appearance of the home appliance, a panel defining an outer appearance on a front surface of the home appliance may be provided.

Typically, structures that variously modify the outer appearance of the front surface of the refrigerator so as to be harmonized with environments in which the refrigerator is placed, surrounding furniture, or other home appliances are being developed, and this trend is being made throughout the home appliances.

U.S. Patent Application No. 8789900 discloses a structure in which a decoration panel defining an outer appearance is installed on a door front of a refrigerator, and here, the outer appearance of the door front is defined according to a user's preference by detachably configuring the decoration panel.

However, the refrigerator having this structure has a problem in that, when a user wants to change the outer appearance, the entire decoration panel needs to be removed and replaced, and it is not possible to use the decoration panel before replacement any longer.

To solve this limitation, Chinese Patent Application No. 103250018 discloses a refrigerator in which a reflective layer and a transparent panel are disposed on a door front and colored light emitting members are mounted on both side ends of the reflective layer to cause the transparent panel to shine with set color.

However, in such a structure, there is a limitation in that a structure, which is firmly coupled while being easily mounted between a door and a panel, is not provided. In particular, when the panel is mounted on the door, frequent opening and closing of the door and a repeated impact are applied, and thus, a firmly coupling structure between the door and the panel is required.

In addition, since the panel is made of a heavy material such as glass, the panel itself is heavy, or in home appliances such as a refrigerator having a long vertical length, this limitation is more serious.

SUMMARY

Embodiments provide a home appliance in which all of upper and lower ends and left and right ends of a panel assembly are fixed to a door body so as to be maintained in a stable state.

Embodiments also provide a home appliance having a structure, in which a door body and a panel assembly are firmly coupled to each other, to prevent the panel assembly from moving.

Embodiments also provide a home appliance in which lifting between a door body and both ends of a panel assembly is prevented from occurring to improve quality of an outer appearance thereof.

Embodiments also provide a home appliance in which a panel holder for mounting a panel assembly is more firmly mounted.

In one embodiment, a home appliance includes a cabinet in which a storage space is defined and a door configured to open and close the storage space, wherein the door includes: a door body connected to the cabinet; and a panel assembly mounted on a front surface of the door body, wherein the panel assembly includes: a panel which is configured to define a front surface of the door and through which light is transmitted; a light guide plate disposed behind the panel to irradiate light toward the panel; a lighting device configured to irradiate light toward an end of the light guide plate and allow the panel to shine with a set color; a mounting member coupled to both left and right ends of the light guide plate to fix the light guide plate; a back cover configured to define a rear surface of the panel assembly; and a panel holder provided along both left and right ends of a rear surface of the panel assembly and coupled to the door body, wherein the panel holder is coupled to the mounting member inside the panel assembly and protrudes backward to pass through the back cover so as to be restricted on the door body.

The panel assembly may include: a base inserted into and fixed in the mounting member; and a holder protrusion protruding backward from the base and inserted into the door body.

The base may have at least one surface having a planar shape parallel to the light guide plate and supported on a rear surface of the light guide plate.

The holder protrusion may include a holder extension portion extending vertically; and a holder hook portion having a thickness greater than that of the extension portion at a protruding end of the holder extension portion so as to be hooked and restricted inside the door body.

A boss may be disposed on each of upper and lower portions of the base with respect to the holder protrusion, and a screw passing through the back cover may be coupled to the boss to restrict the panel holder.

The base may include: a base insertion portion inserted into the mounting member; and a base exposed portion which is exposed to the outside of the mounting member and on which the holder protrusion is disposed.

A base stepped portion protruding in a stepped shape may be disposed on an end of the base exposed portion that is in contact with the base insertion portion, and the base stepped portion may be in close contact with an end of the mounting member when the panel holder is mounted.

A holder restriction groove recessed in a direction crossing the extension direction of the mounting member may be defined in the end of the mounting member, and a holder restriction protrusion protruding from the base stepped portion so as to be coupled to the holder restriction groove when the panel holder is inserted into the mounting member may be provided.

The mounting member may be made of a light-transmittable material and may include a front surface portion which is configured to divide the panel and the light guide plate into each other and on which the panel is mounted on a front surface thereof; and a side surface portion a side surface portion extending backward from each of both ends of the front surface portion so as to be coupled to each of both ends of the light guide plate.

The side surface portion may include: a first part extending backward from an end of the front surface portion and configured to define at least a portion of an outer surface of the panel assembly; and a second part which extends inward from an end of the first part and on which the light guide plate and the panel holder are mounted.

A third part that is stepped is disposed between the first part and the second part, a first insertion space into which the light guide plate is inserted may be defined between the front surface portion and the third part, and a second insertion space into which the panel holder is inserted in the state in which the light guide plate is inserted into the first insertion space may be defined between the front surface portion and the second part.

The panel assembly may further include: an upper bracket configured to define a top surface thereof; and a lower bracket configured to define a bottom surface thereof, wherein the second insertion space may have upper and lower ends, which are opened, so that the upper bracket and the lower bracket are inserted and mounted.

The panel holder may be provided in plurality between the upper bracket and the lower bracket along the side surface portion.

The door body may have a plate opening, into which the panel holder is inserted when the panel assembly is mounted, in a front surface thereof, and a holder case to which an end of the panel holder inserted through the plate opening is restricted may be provided inside the door body.

The holder case may include: a case body fixed and mounted so that a front surface of the holder case is in contact with the door body; a holder accommodation portion recessed in the case body; and a case restriction portion protruding from the inside of the case restriction portion, wherein the case restriction portion may be provided in a pair, which are spaced apart from each other, and the holder protrusion may be inserted and restricted between the pair of case restriction portions.

The extending end of the case restriction portion and the extending end of the holder protrusion may be in contact with each other when the panel assembly is detached and may have inclined or rounded shapes.

The door body may include: a body plate configured to define a front surface of the door body facing the panel assembly; and a side decoration configured to define both left and right surfaces of the door body, wherein a decoration supporting portion protruding inward and coupled to an end of the body plate may be disposed at one side that is away from a front end of the side decoration, and the holder case may have one end supported on the body plate and the other end supported on the decoration supporting portion.

The back cover may include: a cover protrusion disposed at a position including a central portion of the back cover and protruding forward to support the light guide plate at a rear side; and a cover circumferential portion extending up to the end of the back cover along a circumference of the cover protrusion, wherein the panel holder may protrudes backward by passing through the cover circumferential portion, and both ends of the cover circumferential portion may be supported by the mounting member.

The panel assembly may include an upper bracket configured to define a top surface of the panel assembly; and a lower bracket which is configured to define a bottom surface of the panel assembly and in which the lighting device is mounted, wherein the upper and lower ends of the back cover may be coupled to the upper bracket and the lower bracket, respectively.

An upper protrusion protruding backward and inserted into the front surface of the door body may be disposed on the upper bracket, and a lower protrusion coupled to a bottom surface of the lower bracket and protruding backward to be coupled to the door body may be disposed on the lower bracket, wherein a screw may be coupled to the lower protrusion so that a lower end of the panel door and a lower end of the door body are coupled to each other.

In another embodiment, a panel assembly for a home appliance includes: a panel which is configured to define a front surface of the door and through which light is transmitted; a light guide plate disposed behind the panel to irradiate light toward the panel; a lighting device configured to irradiate light toward an end of the light guide plate and allow the panel to shine with a set color; a mounting member coupled to both left and right ends of the light guide plate to fix the light guide plate; a back cover configured to define a rear surface of the panel assembly; and a panel holder provided along both left and right ends of a rear surface of the panel assembly and coupled to the door body, wherein the panel holder is coupled to the mounting member inside the panel assembly and protrudes backward to pass through the back cover so as to be restricted on the door body.

The details of one or more embodiments are set forth in the accompanying drawings and the description below. Other features will be apparent from the description and drawings, and from the claims.

BRIEF DESCRIPTION OF THE DRAWINGS

FIG. 24 is a front view illustrating an outer appearance of a front surface of the refrigerator that is in a state in which the lighting device is turned on.

FIG. 29 is a front view of a front appearance of a refrigerator in the state in which a lighting device of the refrigerator is turned on.

DETAILED DESCRIPTION OF THE EMBODIMENTS

Hereinafter, detailed embodiments will be described in detail with reference to the accompanying drawings. However, the present disclosure is limited to the embodiments in which the spirit of the present invention is proposed, and other degenerate idea or other embodiments included in the scope of the present invention may be easily proposed by addition, changes, deletions, etc. of other elements.

Prior to a description, directions are defined. In an embodiment of the present disclosure, a direction toward a door is defined as a front direction with respect to a cabinet shown in FIGS. 2 and 2, a direction toward the cabinet with respect to the door is defined as a rear direction, a direction toward a bottom on which a refrigerator is installed is defined as a downward direction, and a direction away from the bottom is defined as an upward direction.

Figure 1:
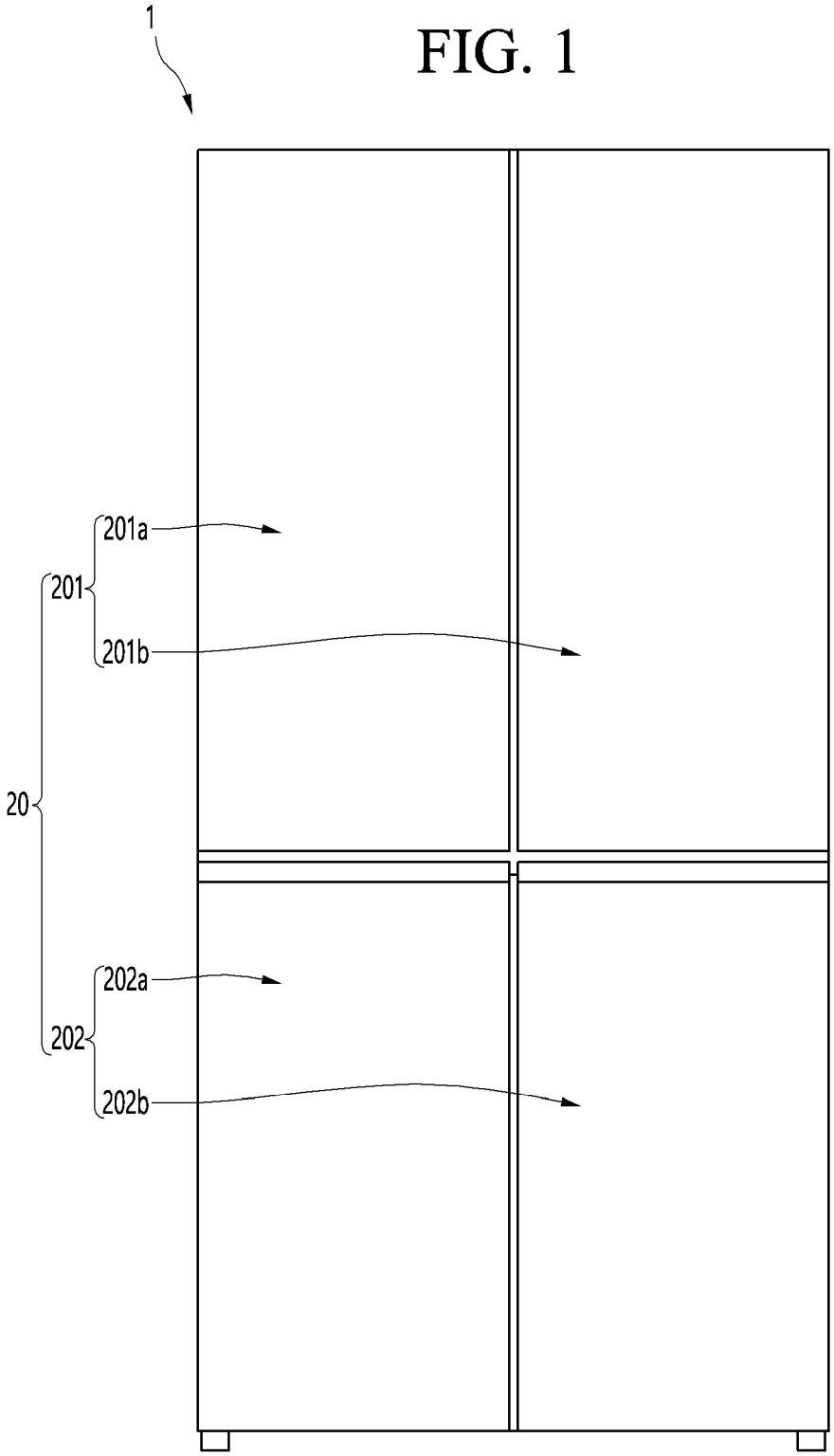
FIG. 1 is a front view of a refrigerator according to an embodiment.
Figure 2:
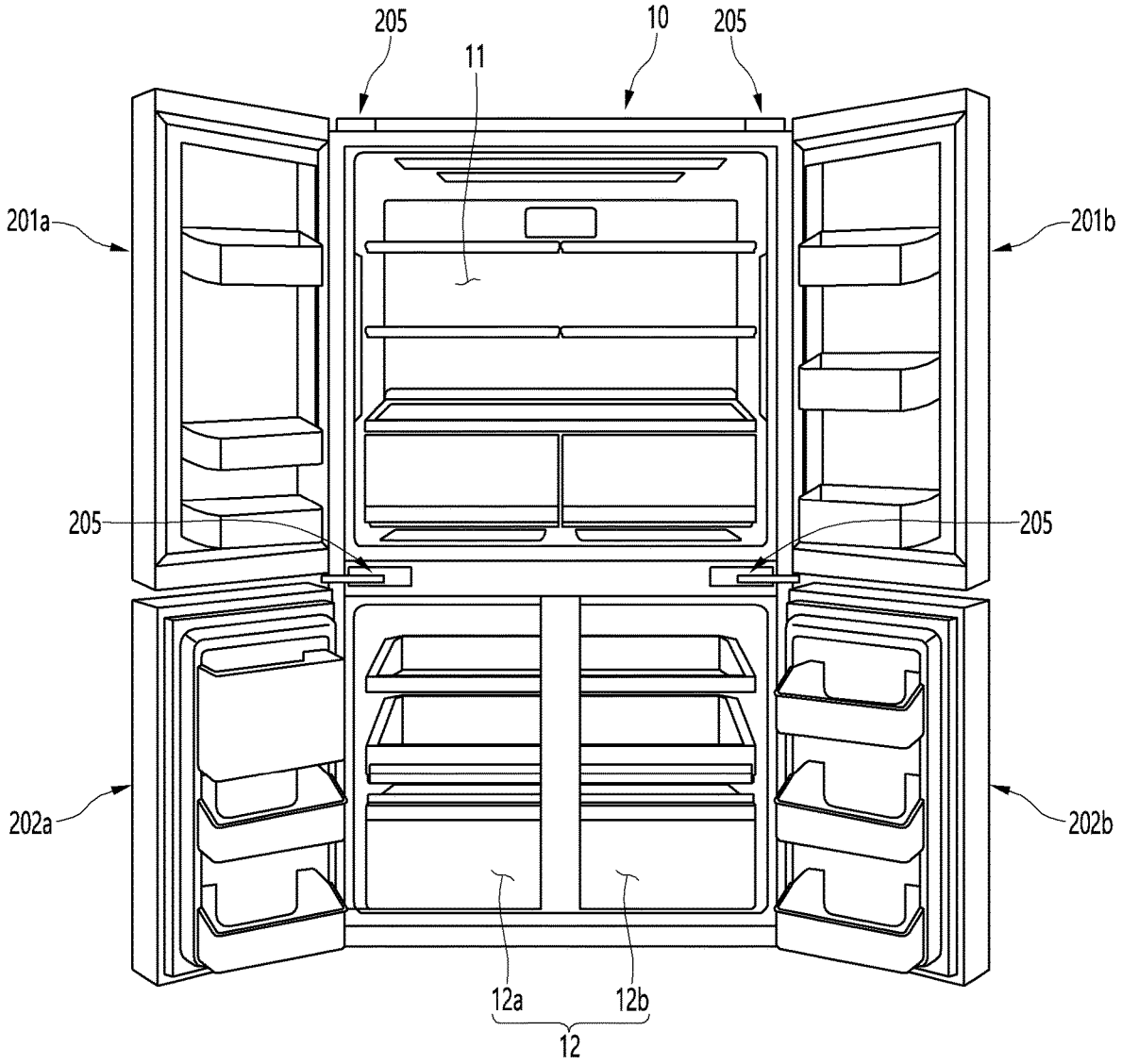
FIG. 2 is a front view illustrating a state in which a door of the refrigerator is opened.

FIG. 1 is a front view of a refrigerator according to an embodiment. Also, FIG. 2 is a front view illustrating a state in which a door of the refrigerator is opened.

As illustrated in the drawings, an outer appearance of a refrigerator 1 according to an embodiment may be defined by a cabinet 10 in which a storage space is defined, and a door 20 for opening and closing the storage space of the cabinet 10.

For example, the cabinet 10 may define the storage space partitioned in a vertical direction Here, a refrigerating compartment 11 may be defined at an upper portion of the cabinet 10, and a freezing compartment 12 may be defined at a lower portion of the cabinet 10. The refrigerating compartment 11 may be referred to as an upper storage space, and the freezing compartment 12 may be referred to as a lower storage space. In addition, the freezing compartment 12 may be divided into left and tight sides to define a left freezing chamber 12*a* and a right freezing chamber 12*b*. The left freezing compartment 12*a* may be referred to as a left lower storage space, and the right freezing compartment 12*b* may be referred to as a right lower storage space.

The door 20 may be configured to open and close each of the refrigerating compartment 11 and the freezing compartment 12. For example, the door 20 may be rotatably mounted to the cabinet 10, and each of the refrigerating compartment 11 and the freezing compartment 12 may be opened and closed by the rotation. Of course, the door 20 may also be withdrawn to open and close each of the refrigerating compartment and the freezing compartment.

The door 20 may include a refrigerating compartment door 201 that opens and closes the refrigerating compartment 11 and a freezing compartment door 202 that opens and closes the freezing compartment 12. The refrigerating compartment door 201 may be referred to as an upper door, and the freezing compartment door 202 may be referred to as a lower door.

The refrigerating compartment door 201 may include a pair of a left refrigerating compartment door and a right refrigerating compartment door, which are arranged side by side. The left refrigerating compartment door 201*a* and the right refrigerating compartment door 201*b* may be disposed adjacent to each other and may have the same size. In addition, the left refrigerating compartment door 201*a* and the right refrigerating compartment door 201*b* may independently rotate to open and close the refrigerating compartment 11.

Upper and lower ends of the refrigerating compartment door 201*a* and the refrigerating compartment door 201*b* may be coupled to the cabinet 10 by hinge devices 205, respectively. The hinge device 205 may include an upper hinge 205 and a lower hinge 205, and the refrigerator compartment door 201*a* and the refrigerating compartment door 201*b* may be rotatably mounted thereon.

In addition, the freezing compartment door 202 may include a pair of a left freezing compartment door 202*a* and a right freezing compartment door 202*b*, which are arranged side by side. In addition, the left freezing compartment door 202*a* and the right freezing compartment door 202*b* may independently rotate to open and close the freezing compartment. The left freezing compartment door 202*a* and the right freezing compartment door 202*b* may be disposed adjacent to each other and may have the same size.

Of course, although the refrigerator having a structure in which a refrigerating compartment 11 is disposed at an upper side, and a freezing compartment 12 is disposed at a lower side is described as an example in the embodiment, the present disclosure may be applied to all types of refrigerators equipped with a door without being limited to types of refrigerators.

An outer appearance of the front surface of the refrigerator 1 may be defined in the state in which the door 20 is closed and may define the out appearance of the refrigerator 1 viewed from the front in the state in which the refrigerator 1 is installed.

The door 20 may have a structure in which a front surface selectively emits light and may be configured to shine with set color or brightness. Thus, a user may change front color or brightness of the door 20 without separating or disassembling the door 20 and may change the overall outer appearance of the refrigerator 1.

Hereinafter, the structure of the door 20 will be described in detail with reference to drawings. In addition, an embodiment of the present disclosure will be described with reference to the left refrigerating compartment door 201*a*, and other doors 201*b*, 202*a*, and 202*b* may also have the same structure.

Figure 3:
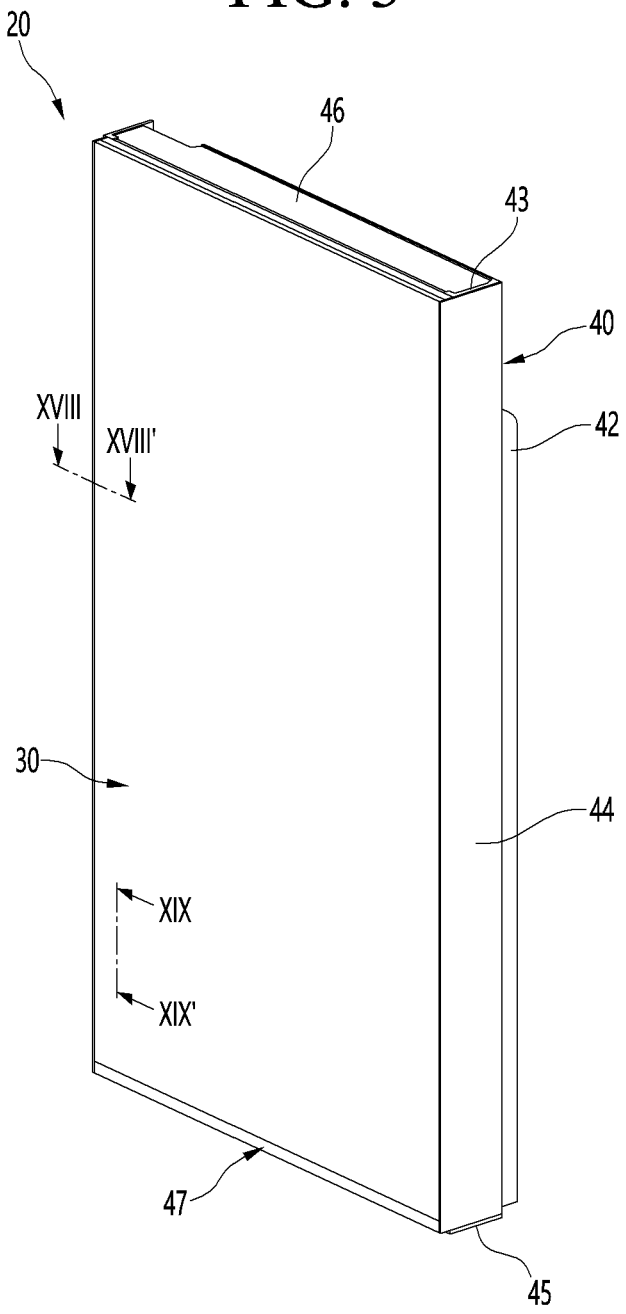
FIG. 3 is a perspective view of the door.
Figure 4:
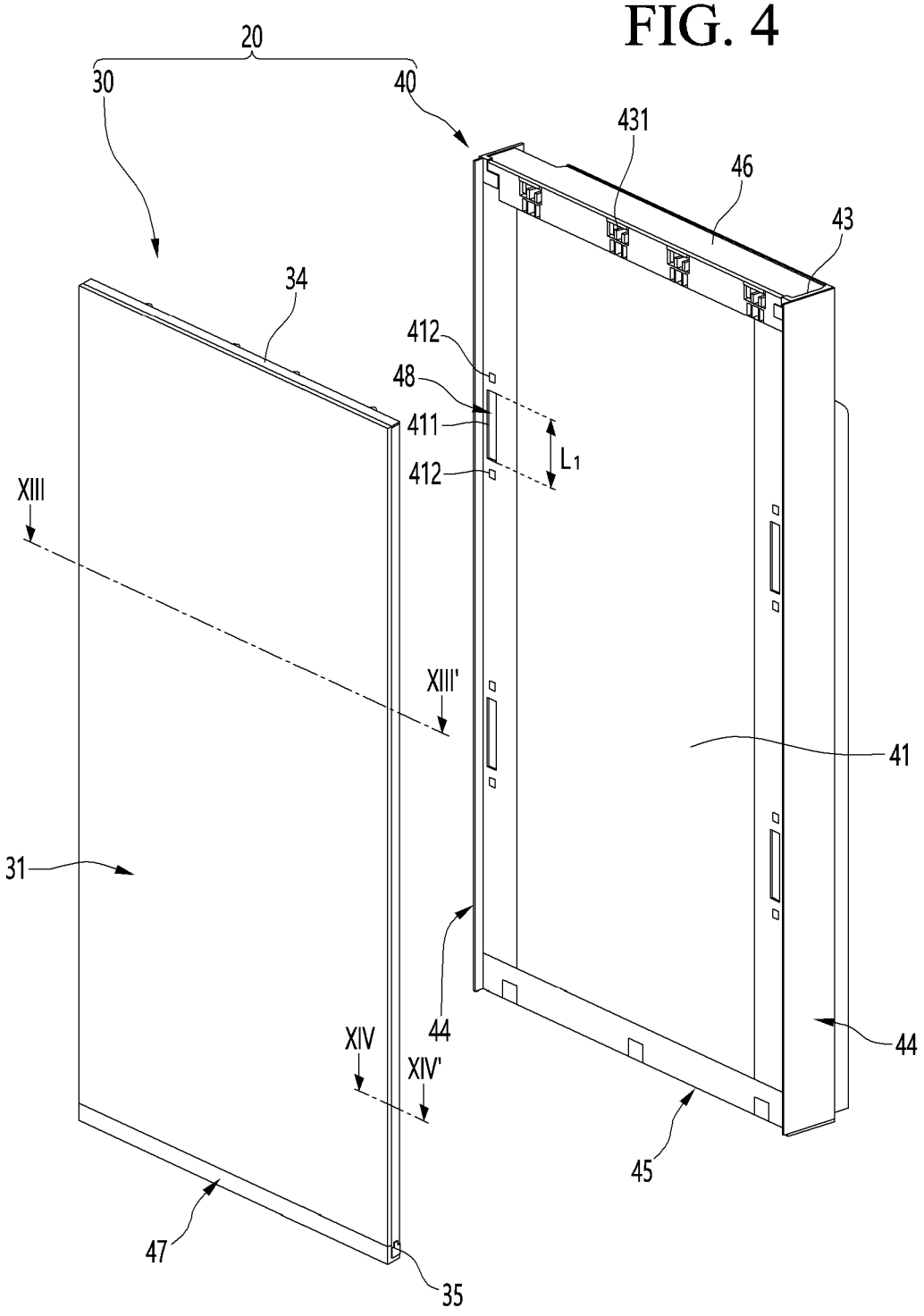
FIG. 4 is an exploded perspective view illustrating a state in which a panel assembly and a door body, which are components of the door, are separated from each other.
Figure 5:
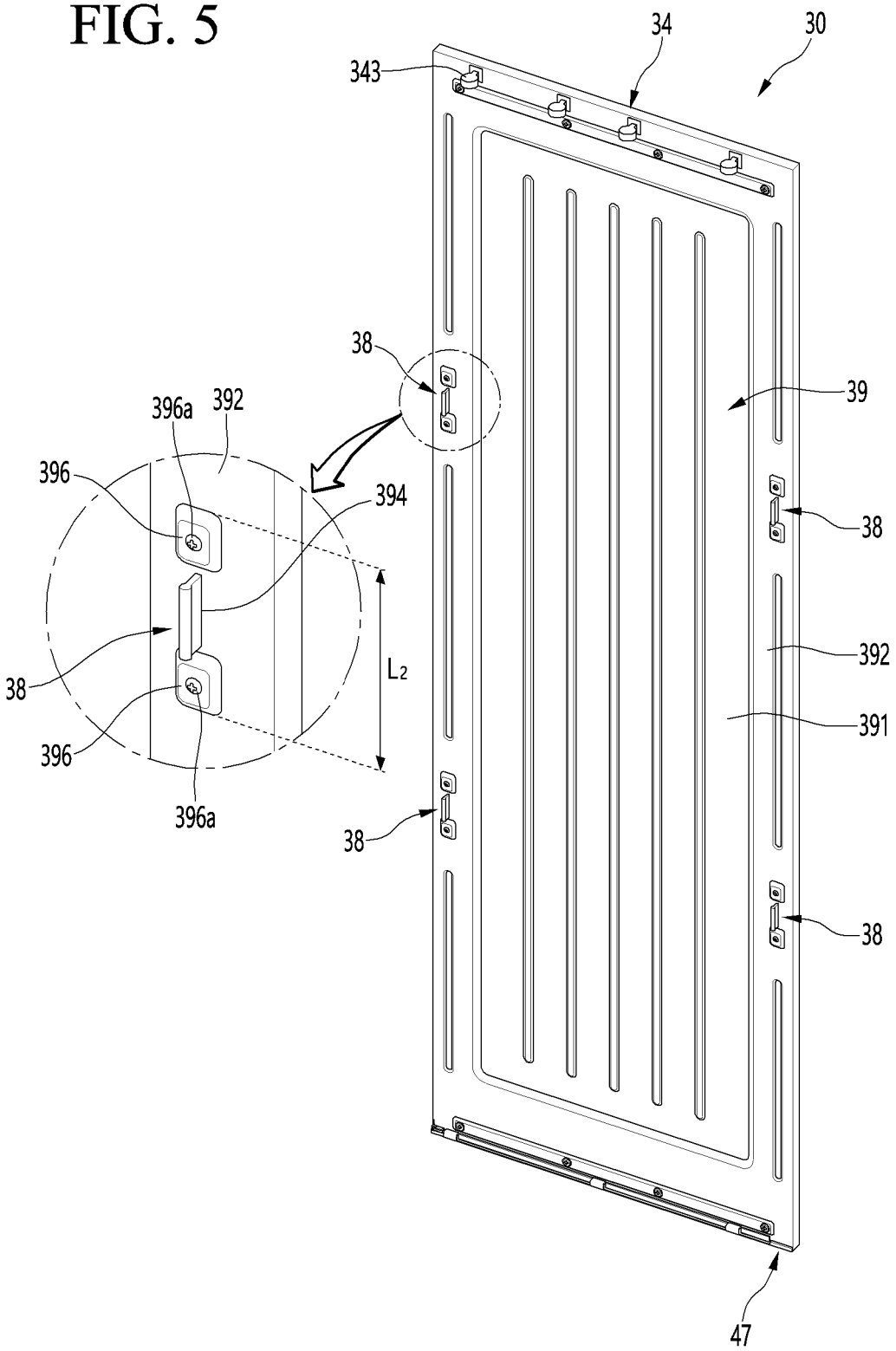
FIG. 5 is a rear perspective view of the panel assembly.

FIG. 3 is a perspective view of the door. In addition, FIG. 4 is an exploded perspective view illustrating a state in which a panel assembly and a door body, which are components of the door, are separated from each other. Also, FIG. 5 is a rear perspective view of the panel assembly.

As illustrated in the drawings, the door 20 may include a door body 21 defining the overall shape of the door 20, and a panel assembly 30 defining an outer appearance of a front surface of the door 20. That is, the door 20 may be configured so that the panel assembly 30 is mounted on a front surface of the door body 40.

The door body 40 may include a body plate 41 defining a front surface and a door liner 42 defining a rear surface. The body plate 41 may be made of a metal material and disposed to face a rear surface of the panel assembly 30. The door liner 42 may be made of a plastic material and may form a bottom shape of the door 20.

The door body 40 may include a side decoration 44 defining right and left side surfaces of the door body 21. The side decoration 44 may connect both right and left ends of the body plate 41 and both right and left ends of the door liner 42.

The door body 40 may include an upper cap decoration 43 and a lower cap decoration 45 that form top and bottom surfaces of the door body 40. The upper cap decoration 43 may be connected to an upper end of the side decoration 44, an upper end of the body plate 41, and an upper end of the door liner 42. The lower cap decoration 45 may be connected to a lower end of the side decoration 44, a lower end of the body plate 41, and a lower end of the door liner 42.

An outer appearance of the door body 40 may be defined by the body plate 41, the door liner 42, the side decoration 44, the upper cap decoration 43, and the lower cap decoration 45. In addition, an insulator may be filled in an internal space of the door body 40, which is defined by coupling the body plate 41, the door liner 42, the side decoration 44, the upper cap decoration 43, and the lower cap decoration 45.

The panel assembly 30 may be inserted into and mounted on the front surface of the door body 40. For example, the side decoration 44 may further protrude forward and may be in contact with both ends of the panel assembly 30. In addition, a top surface of the panel assembly 30 may define the same plane as the upper cap decoration 43 to define the top surface of the door 20, and the bottom surface of the panel assembly 30 has the lower cap decoration 45 to define the same plane as the bottom surface of the door 20.

The panel assembly 30 may be provided in a plate shape and may define an outer appearance of the front surface of the door 20 while being mounted on the front surface of the door body 40. Since the panel assembly 30 may form the outer appearance of the front surface of the door 20, the panel assembly 30 may be referred to as a door panel, and since the panel assembly 30 may form the outer appearance of the front surface of the refrigerator 1, the panel assembly 30 may also be referred to as an exterior panel.

The panel assembly 30 may be detachably mounted on the door body 40. An upper protrusion 343 and a lower protrusion 473, which protrude backward, may be disposed on upper and lower ends of the rear surface of the panel assembly 30, respectively. In addition, an upper mounting portion 431 into which the upper protrusion 343 is inserted and mounted may be opened at an upper end of the front surface of the door body 40. In addition, although not shown in detail, the upper protrusion 343 may be restricted by an upper cover 46 mounted on an opened top surface of the upper cap decoration 43.

The panel assembly 30 may include a lower decoration 47. The lower decoration 47 may define an outer appearance of the lower end of the panel assembly 30, and the lower end of the panel assembly 30 may be fixed to the door body 40.

The lower decoration 47 may be made of a plastic material and may be coupled under the lower bracket 35 to shield the lower bracket 35. That is, in the state in which the panel assembly 30 is mounted on the door body 40, the lower bracket 35 may not be exposed by the lower decoration 47 and be coupled to the door body 40.

Figure 21:
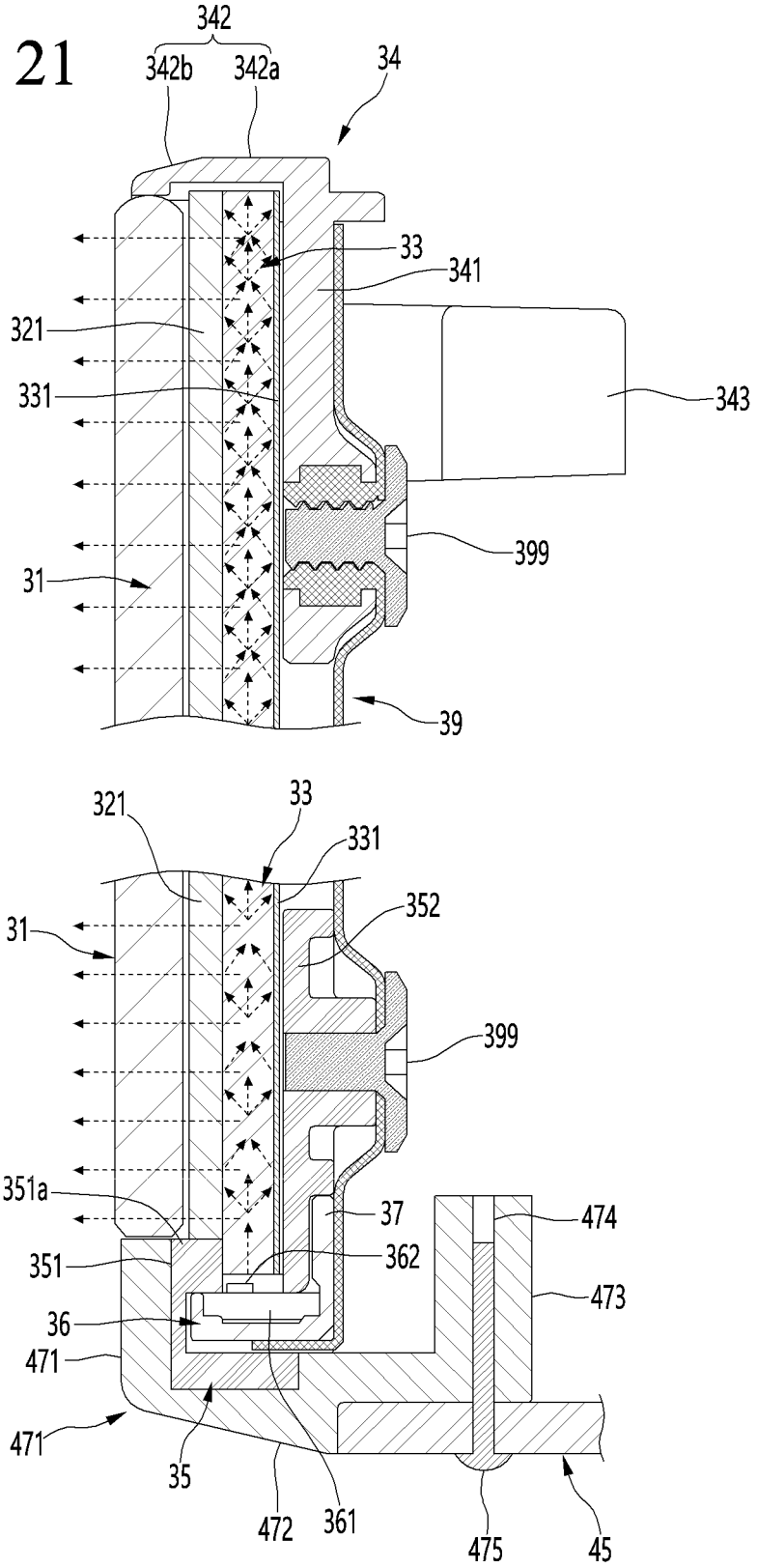
FIG. 21 is a cross-sectional view illustrating an emission state of the panel assembly.

The lower decoration 47 may be provided with a lower protrusion 473 to which a screw (reference numeral 475 of FIG. 21) for restricting the lower end of the panel assembly 30 is coupled, and the lower protrusion 473 may be firmly mounted on the lower mounting portion 451 of the lower end of the door body 40. For example, as illustrated in FIG. 21, a rear end of the lower decoration 47 may be seated on the lower cap decoration 45 of the lower end of the door body 40, and the screw 475 may be coupled to pass through the lower cap decoration 45 and the lower protrusion 473, and thus, the lower end of the panel assembly 30 may be firmly fixed to the door body 40.

Since the panel assembly 30 moves in the forward and backward direction, the upper protrusion 343 and the lower protrusion 473 may be coupled to the upper mounting portion 431 and the lower mounting portion 451 of the door body 40, and thus, the upper and lower ends of the panel assembly 30 may be fixed.

In addition, a panel holder 38 may be further provided on the rear surface of the panel assembly 30. The panel holder 38 may protrude backward from each of both left and right ends of the rear surface of the panel assembly 30. The panel holder 38 may be provided in plurality in the vertical direction. For example, two pairs of panel holders 38 may be respectively provided at both the left and right sides of the rear surface of the panel assembly 30 and may be disposed at regular intervals.

The panel holder 38 may protrude through the back cover 39 defining the rear surface of the panel assembly 30. That is, a portion of the panel holder 38 may be fixed inside the panel assembly 30, and the remaining portion may protrude.

In addition, a holder case 48 coupled to the panel holder 38 may be disposed on the front surface of the door body 40, which corresponds to the panel holder 38. The holder case 48 may be provided inside the door body 40, and the holder case 48 may be fixedly mounted in a case fixing hole 412 defined in the body plate 41. In addition, at least a portion of the holder case 48 may be exposed through a plate opening 411 defined in the body plate 41.

A vertical length L1 of the plate opening 411 may be greater than a vertical length L3 of the holder protrusion 384 to be described below. In addition, the vertical length L1 of the plate opening 411 may be greater than a vertical distance L2 up to an end of each of the holder mounting portions 396 disposed at upper and lower portions of the cover opening 394. Thus, when the panel assembly 30 is mounted to the door body 40, the holder protrusion 384 and the holder mounting portion 396 may be inserted inside the plate opening 411, and thus, the panel assembly 30 may be mounted to be in close contact with the front surface of the door body 40.

In addition, the panel assembly 30 may move backward to mount the panel assembly 30 so as to be coupled to the door body 40. That is, when the panel assembly 30 moves backward, the panel holder 38 may pass through the plate opening 411 so as to be coupled to the holder case 48. The panel holder 38 and the holder case 48 may be coupled to each other so that both the left and right ends of the panel assembly 30 are firmly fixed and coupled to the door body 40.

As described above, the upper and lower ends and both the left and right ends of the panel assembly 30 may be fixed to the door body 40 through a single process in which the panel assembly 30 moves backward toward the front surface of the door body 40. In addition, the panel assembly 30 may move forward so as to be separated from the door body 40 while the panel assembly 30 is mounted on the door body 40. Thus, the panel assembly 30 may be easily separated from and mounted on the door body 40 for services and maintenance.

The structures of the panel holder 38 and the holder case 48 for fixing the left and right side ends of the panel assembly 30 will be described in more detail below.

A front surface of the panel assembly 30 may be exposed forward in the state in which the panel assembly 30 is mounted on the door body 40, and the panel assembly 30 may substantially form the outer appearance of the front surface of the door 20. That is, a color of the outer appearance of the front surface of the door 20 may be determined by a color of the front surface of the panel assembly 30. In addition, the entire front surface of the panel assembly 30 may be configured to shine in a color specified by the user and may be changed to various colors selected by the user to express the color of the front surface of the door 20 in various manners.

Hereinafter, the structure of the panel assembly 30 will be described in more detail with reference to drawings.

Figure 6:
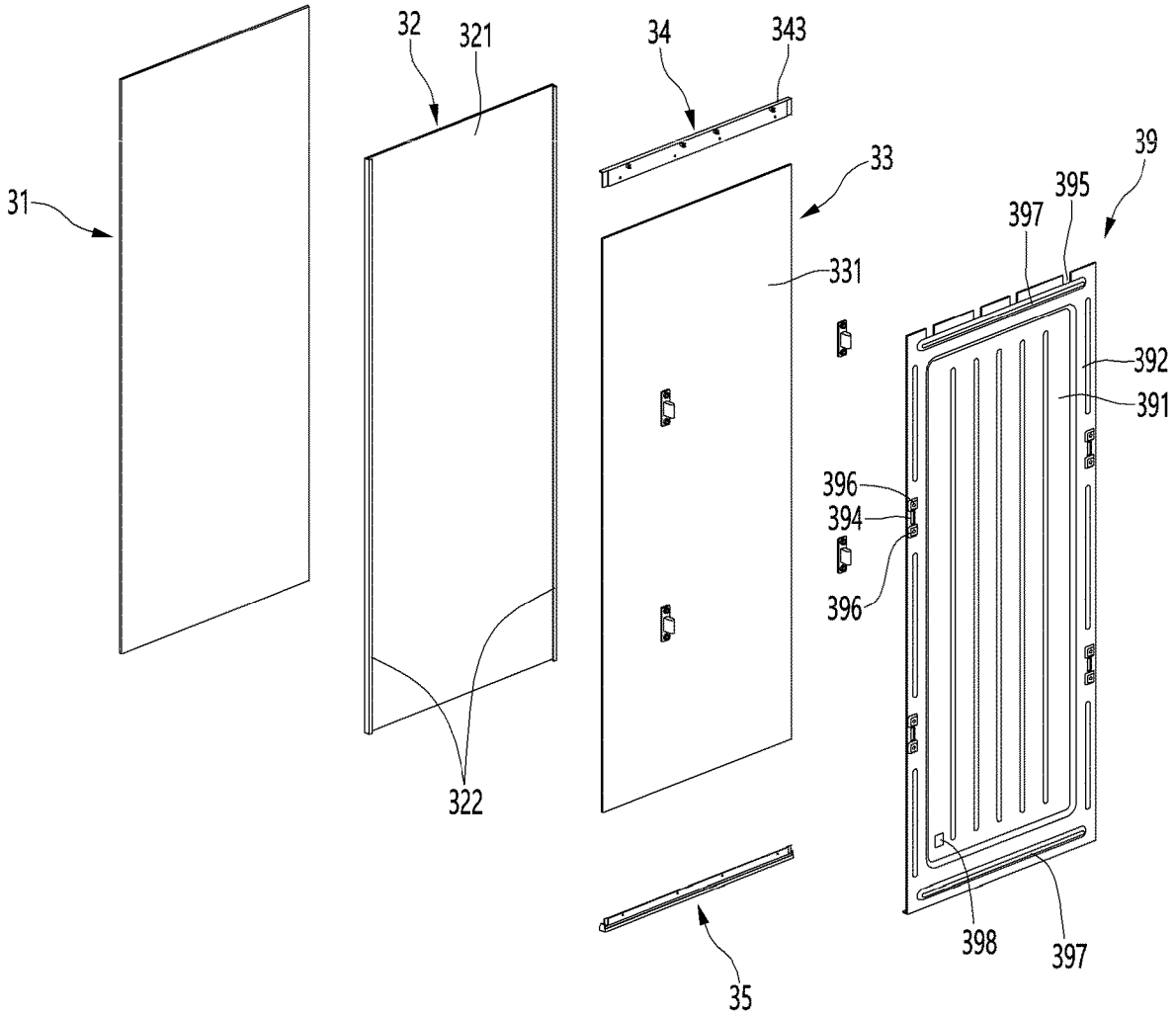
FIG. 6 is an exploded perspective view of the panel assembly.

FIG. 6 is an exploded perspective view of the panel assembly.

As illustrated in the drawings, the panel assembly 30 may further include a panel 31 defining an outer appearance of the front surface, a lighting device 36 emitting light to allow the panel 31 to shine, a back cover defining a rear surface of the panel assembly 30, and a panel holder 38 that fixes the door body 40 to the panel assembly 30.

In addition, the panel assembly 30 may include a light guide plate 33 that guides light irradiated from the lighting device 36 and a mounting member 32 on which both ends of the light guide plate are mounted.

The panel assembly 30 may include an upper bracket 34 forming a top surface of the panel assembly 30 and a lower bracket 35 forming a bottom surface of the panel assembly 30. The lighting device 36 may be mounted on the lower bracket 35.

In more detail, the panel 31 may be provided in a rectangular plate shape and may be made of a material that transmits light therethrough. For example the panel 31 may be made of a glass material such as blue glass, white glass, and vapor deposition glass or may be made of other materials for transmitting light therethrough, such as ABS, PMMA, or PC. In addition, the panel 31 may have a thickness set so as not to be easily broken due to characteristics of defining an outer appearance thereof. The panel 31 may have a thickness greater than that of the light guide plate 33. For example, the panel 31 may have a thickness of approximately 3 mm to 5 mm. The panel 31 may be referred to as a transparent plate or an out plate.

The panel 31 may be transparent to allow light reflected by the light guide plate 33 to be transmitted. In this case, the transparency may be defined as a degree to which the light reflected from the light guide plate 33 is transmitted and irradiated to the outside to identify that the panel 31 shines in a specific color.

In addition, in all embodiments of the present disclosure, the terms "transparent" and "transmission" may be defined as a state in which the light passes to display a set color through the panel 31.

In addition, the panel 31 may be provided to have a color. That is, in a state in which the lighting device 36 is turned off, a color of the front surface of the door 20 may be expressed by the color of the panel. The color of the panel may not be changed in a state in which the lighting device 36 is turned off, and the user may select and install a color desired by the user through replacement of the panel assembly.

For example, a specific design or pattern may be printed on the panel 31 to have specific color. A film with a specific design or pattern printed thereon may be added to the panel 31, surface treatment such as imprinting, etching, and glass printing may be performed on the panel 31, or a coating or deposition layer having specific color and texture may be provided to define an outer appearance of the panel 31.

The front panel 31 may be configured to transmit light emitted from the lighting device 36 but components behind the front panel 31 may not be seen therethrough. That is, in the state in which the lighting device 36 is turned off, components inside the panel assembly 30 may be prevented from being seen to the outside through the panel 31 due to the color of the panel 31.

Here, the panel 31 may be provided with a color layer 311 having a color. Here, in an off state, the color layer 311 may have at least color having brightness equal to or greater than 0 other than black. That is, in a state in which the refrigerator 1 is installed, the front surface of the refrigerator 1 may be displayed in a color other than black, and the color of the front surface of the refrigerator may be changed according to an operation of the lighting device 36.

The panel 31 may define the outer appearance of the front surface of the panel assembly 30, which is exposed to the outside. The panel 31 may have a size less than that of the light guide plate 33. Thus, the light emitted from the light guide plate 33 toward the panel 31 may be evenly irradiated to the entirety including an outer end of the panel 31, and the entire panel 31 may be brightly shine without being partially darkened.

In addition, a rear surface of the panel 31 may be mounted on a front surface of the mounting member 32. Here, a horizontal width of the panel 31 may correspond to a horizontal width of the mounting member 32. Thus, in the state in which the panel 31 is mounted, both left and right ends of the mounting member 32 and both left and right ends of the panel 31 may be disposed on the same plane and define both left and right surfaces of the panel assembly 30. Thus, in the state in which the panel 31 is attached to the mounting member 32, when viewed from the front, the components disposed behind the panel in addition to the mounting member 32 may not be exposed to the outside, and the outer appearance of the front surfaces of the panel assembly 30 and the door 20 may be defined.

The light guide plate 33 may be positioned at a rear spaced apart from the panel 31 and may be configured to guide light emitted from the lighting device 36 disposed below the light guide plate 33 forward toward the panel 31.

For example, the light guide plate 33 may be made of a transparent acrylic, plastic, or transparent polymer material. The light guide plate 33 may have a diffusing agent added thereto for diffusing light entrance on the light guide plate 33 or a pattern for diffusing light may be further formed on the light guide plate 33. Thus, light may be transferred to the panel 31 by the light guide plate 33, and in this case, a pattern of the light guide plate 33 may be set to cause the entire front surface of the panel 31 to shine with uniform brightness.

For example, the light guide plate 33 may have a pattern that increases in density upward from a center of the light guide plate 33 so as to have uniform brightness as a whole, and the density of the pattern may gradually increase from the center toward both left and right sides. In addition, the pattern may not be provided at a position closest to the lighting device 36 on the lower end of the light guide plate 33, or the density of the pattern may be provided to be relatively low.

The light guide plate 33 may be entirely provided in a rectangular plate shape and may be formed with a size somewhat greater than that of the panel 31. In detail, the light guide plate may have a width less than that of a left and right width of the panel 31 and greater than a vertical length of the panel 31 so as to be mounted on the mounting member 32.

In addition, a reflective layer (see reference numeral 331 in FIG. 13) may be disposed on a rear surface of the light guide plate 33 so that light inside the light guide plate 33 is directed forward. Thus, the light moving along the light guide plate 33 may be induced to be irradiated toward the panel 31. In addition, the reflective layer may be disposed on each of both ends and an upper end of the light guide plate 33 except for the lower side, on which the lighting device 36 is mounted, so that all the light is directed to the inside of the light guide plate 33 without leaking around the light guide plate 33, and thus, the panel 31 may shine more brightly and uniformly.

The light guide plate 33 may be supported by the back cover 39 from the rear and may be fixed to be maintained at a predetermined interval from the panel 31 by the mounting member 32.

The mounting member 32 may be disposed between the panel 31 and the light guide plate 33. The mounting member 32 may be used to fixedly mount the light guide plate 33 and the panel 31, and in particular, may maintain the light guide plate 33 at a predetermined interval from the panel 31.

The mounting member 32 may have a front surface supporting the panel 31 and both left and right surfaces that restrict the light guide plate 33 disposed at a rear side thereof. The mounting member 32 may be referred to as a support member because the panel 31 and the light guide plate 33 are mounted and may also be referred to as a transparent plate because light passes therethrough. In addition, the mounting member 32 may be referred to as a main frame because the mounting member 32 has a structure including the side surface of the panel assembly 340.

The mounting member 32 may be made of a material capable of transmitting light therethrough and may be provided as a whole by injection or extrusion as a single component. That is, the mounting member 32 may be made of a material having a property of allowing light to pass through and having moldability. For example, the mounting member 32 may be made of an optically transparent ABS material. In addition, the mounting member 32 may be made of various transparent plastic materials, such as polycarbonate (PC), acrylic, or the like. The light reflected from the light guide plate 33 may be transmitted to pass through the panel 31.

The light transmission performance and transparency of the mounting member 32 means a degree to which light irradiated from the rear light guide plate 33 passes through the mounting member 32 to illuminate the panel 31.

In addition, a light diffusing agent may be added when the mounting member 32 is molded. The light diffusing agent may diffuse the light passing through the mounting member 32 and may allow the light to be irradiated more evenly to the entire front panel 31.

The upper bracket 34 may be provided at an upper end of the panel assembly 30. The upper bracket 34 may form a top surface of the panel assembly 30. In addition, the upper bracket 34 may be injection-molded with a plastic material, and may provide a structure coupled to the mounting member 32 and a structure coupled to the back cover 39.

The upper bracket 34 may extend from an upper left end to a right end of the mounting member 32 and may shield the mounting member 32 of the panel assembly 30 and an upper end of the light guide plate 33 so as not to be exposed. In addition, the upper bracket 34 may shield at least a portion of the upper end of the panel 31. Thus, when viewed from above, a top surface of the panel 31 may be defined by the upper bracket 34, and other components constituting the panel assembly 30 may be prevented from being exposed upward.

The back cover 39 may be coupled to the rear surface of the upper bracket 34. That is, when the back cover 39 is coupled, the upper bracket 34 may support the upper end of the light guide plate 33 at the rear side.

The lower bracket 35 may be provided at the lower end of the panel assembly 30. The lower bracket 35 may form a bottom surface of the panel assembly 30. The lower bracket 35 may be injection-molded with a plastic material and may provide a structure coupled to the mounting member 32 and a structure coupled to the back cover 39.

The lighting device 36 may be mounted on the lower bracket 35. The lighting device 36 may be provided inside the lower bracket 35 to irradiate light toward the light guide plate 33 and may be assembled and mounted with the lower bracket 35 in the state of being mounted on the lower bracket 35.

The lower bracket 35 may be coupled to a lower end of the mounting member 32 and may extend from a left end to a right end of the lower end of the mounting member 32. The back cover 39 may be coupled to the rear surface of the lower bracket 35. When the back cover 39 is coupled, the lower bracket 35 may support the light guide plate 33 at the rear side.

Thus, during a process in which the panel assembly 30 is assembled, both right and left ends of the light guide plate 33 may be fixed by the mounting member 32, and the upper and lower ends of the light guide plate 33 may be supported by the upper bracket 34 and the lower bracket 35 at the rear side.

The back cover 39 may form a rear surface of the panel assembly 30 and may be coupled to the upper bracket 34 and the lower bracket 35. The back cover 39 may be made of a metal material such as stainless or aluminum. The back cover 39 may be formed with a size corresponding to the size of the panel assembly 30 and may form an entire shape of the rear surface of the panel assembly 30.

The rear surface of the light guide plate 33 may be supported by a cover protrusion 391 protruding on the center of the back cover 39, at the rear side. Thus, the light guide plate 33 may have a plate-shaped structure having a large size, but in the state in which the back cover 39 is mounted, the light guide plate 33 may have the overall stable support structure and may be maintained in the stably mounted state. The upper bracket 34 and the lower bracket 35 may be provided at positions corresponding to an upper end and a lower end of the back cover 39.

Right and left ends of a cover circumferential portion 392, which form a circumference of the back cover 39, may be in contact with the side surface portion 322 of the mounting member 32, and upper and lower ends of the cover circumferential portion 392 may be in contact with the upper bracket 34 and the lower bracket 35, respectively.

A plurality of screws 399 may be coupled to the upper and lower ends of the cover circumferential portion 392 and may be coupled to the upper bracket 34 and the lower bracket 35 through the back cover 39 to fixedly mount the back cover 39.

In addition, a cover opening 394 through which the panel holder 38 passes may be defined along both left and right ends of the cover circumferential portion 392, and each of upper and lower ends of the cover opening 394 may be provided with a holder mounting portion 396 configured to fix mount the panel holder 38 on upper and lower ends of the cover opening 394. A plurality of cover openings 394 and holder mounting portions 396 may be disposed along both left and right ends of the back cover 39.

The main components constituting the panel assembly 30 will be described in more detail below with reference to the drawings.

Figure 7:
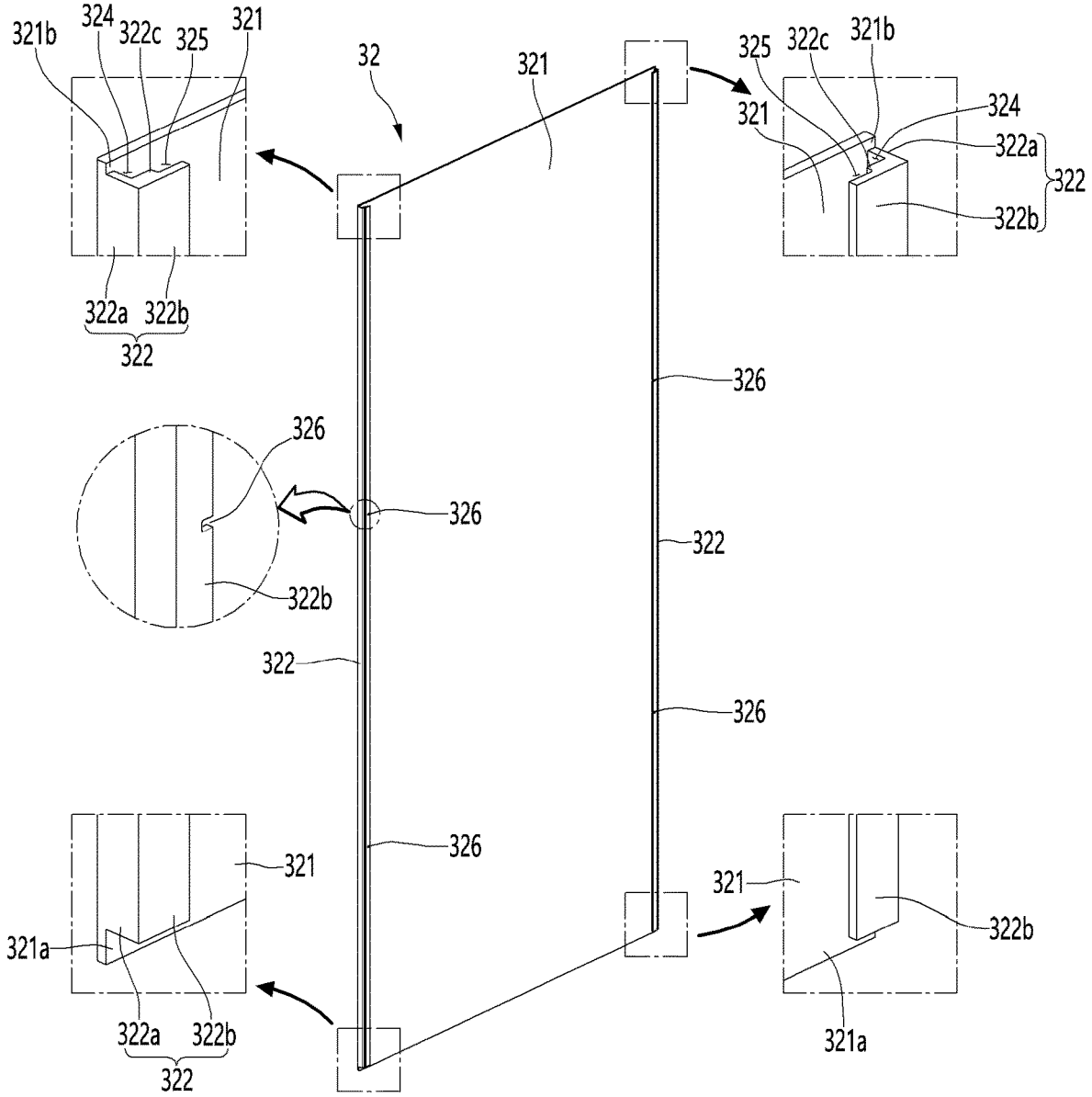
FIG. 7 is a rear perspective view illustrating the mounting member that is a component of the panel assembly.

FIG. 7 is a rear perspective view illustrating the mounting member that is a component of the panel assembly.

As illustrated in the drawing, the mounting member 32 may be entirely made of a resin material. Also, the panel 31 may be mounted on the front surface of the mounting member 32 with respect to the mounting member 32, and the light guide plate 33 may be disposed on the rear surface of the mounting member 32.

The mounting member 32 may include a front surface portion 321 having a plate shape, and a side surface portion 322 that protrudes backward from each of both right and left ends of the front surface portion 321. The front surface portion 321 may be disposed between the panel 31 and the light guide plate 33, the front surface may support the panel 31, and the rear surface may support the light guide plate 33. In addition, the side surface portion 322 may provide a structure on which the light guide plate 33 is fixed, and the upper bracket 34, the lower bracket 35, and the back cover 39 are mounted.

In detail, the front surface portion 321 may be provided in the plate shape having a size corresponding to that of the panel 31, and an adhesive member 313 may be applied around the front surface portion 321 so that the panel 31 adheres to the mounting member 32. Here, the adhesive member 313 may be made of a transparent material or a material capable of transmitting light, and the panel 31 may be configured so that the entire area including an area to which the adhesive member 313 is applied shines.

A left and right width of the front surface portion 321 may be the same as a left and right width of the panel 31. In addition, the upper end of the front surface portion 321 may protrude more upward than the upper end of the panel 31, and the lower end of the front surface portion 321 may protrude more than the lower end of the panel 31. That is, the front surface portion 321 may have a size greater than that of the panel 31, and in particular, may have a length greater than a vertical length of the panel 31.

In addition, the front surface portion 321 may have a structure connecting the side surface portions 322 respectively disposed at both the left and right sides. That is, the front surface portion 321 may be continuously disposed between the side surface portion 322 and may extend from the side surface portion 322 at one side to the side surface portion 322 at the other side.

In the state in which the light guide plate 33 is mounted, the rear surface of the front surface portion 321 may be maintained in the state of being in contact with the front surface of the light guide plate 33. Thus, the light guide plate 33 may be always maintained at a constant distance from the panel 31. Here, the front surface portion 321 may be extruded to be maintained at set flatness, and thus, when the light guide plate 33 is mounted, the front surface portion 321 may be in contact with the entire front surface of the light guide plate 33. Thus, the molding may be performed to prevent an irregular interval or gap from occurring between the front surface portion 321 and the light guide plate 33.

The side surface portion 322 may be disposed along both the left and tight ends of the light guide plate 33. The side surface portion 322, may be stepped with respect to upper and lower ends of the front surface portion 321 and may be provided to match side ends of the upper bracket 34 and the lower bracket 35.

The mounting member 32 may have the same cross-sectional structure in the vertical direction and thus may be simply molded by the extrusion. Simultaneously, a structure in which the panel 31 and the light guide plate 33 are mounted using the front surface portion 321 and the side surface portion 322 may be provided. In addition, the upper bracket 34, the lower bracket 35, and the back cover 39 may be mounted through the structure of the side surface portion 322.

In detail, the side surface portion 322 may include a first part 322*a* extending backward from each of both left and right ends of the front surface portion 321 and a second part 323 bent from an end of the first part 322*a*.

The first part 322*a* may extend perpendicular to the front surface portion 321 from each of both the left and right ends of the front surface portion 321 and may define a side surface of the panel assembly 30.

The second part 322*b* may be bent inward from the extending end of the first part 322*a*. That is, the pair of second parts 322*b* that are disposed on the pair of the first parts 322*a*, respectively, may extend to face each other.

The second part 322*b* may extend perpendicular to the first part 322*a*. The second part 322*b* may be configured to restrict the light guide plate 33 and simultaneously restrict both the ends of the upper bracket 34 and the lower bracket 35. In addition, the second part 322*b* may extend from an upper end to a lower end of the first part 322*a* and may support both left and right ends of the back cover 39.

A third part 322*c* may be disposed between the first part 322*a* and the second part 322*b*. The second part 322*b* and the third part 322*c* are disposed to correspond to a vertical length of the first part 322*a* and may extend from the upper end to the lower end of the first part 322*a*. In addition, the third part 322*c* may protrude from a front surface of the second part 322*b*, that is, a surface facing the front surface portion 321, and the front surface of the second part 322*b* has a stepped shape.

Thus, a first insertion space 324 and a second insertion space 325 may be defined in the side surface portion 322 by the first part 322*a*, the second part 322*b*, and the third part 322*c*, respectively.

In detail, the third part 322*c* may be disposed parallel to the front surface portion 321, and the first insertion space 324 may be defined between the front surface portion 321 and the third part 322*c*, which are spaced apart from each other. Here, the third part 322*c* may extend from a rear end of the first part 322*a*, and a distance between the front surface portion 321 and the third part 322*c* may be defined to correspond to a thickness of the light guide plate 33 so that the light guide plate 33 may be slidably inserted therein. Also, in the state in which the light guide plate 33 is inserted, both the left and right ends of the light guide plate 33 may be restricted to both the ends of the mounting member 32. Here, the front surface of the light guide plate 33 may be in contact with a rear surface of the front surface portion 321.

In addition, in the state in which the light guide plate 33 is inserted into the first insertion space 324, the lower end of the light guide plate 33 may be disposed to face the lighting device 36. In particular, the light guide plate 33 may be disposed on the same extension line as the light source 362 of the lighting device 36, and in the state in which the light guide plate 33 is fixedly inserted into the first insertion space 324, movement in forward and backward directions of the light guide plate 33 may be restricted.

That is, even if the door 20 is repeatedly opened and closed, the light guide plate 33 may be in contact with the front surface portion 321, may be maintained at a predetermined interval from the panel 31, and may not deviate from a position at which the light guide plate 33 is originally installed. The state in which the light guide plate 33 is disposed on the same extension line as the light source 362 included in the lighting device 36 may be maintained, and thus it may be possible to ensure that light emitted from the light source 362 is directed toward an end of the light guide plate 33.

In addition, the second part 322*b* may be disposed on the extending end of the third part 322*c*. The second part 322*b* may be disposed to be stepped with respect to the third part 322*c* and may be disposed more backward than the third part 322*c*. That is, the third part 322*c* may be disposed to protrude more forward than the front surface of the second part 322*b*.

The second part 322*b* may be disposed parallel to the front surface portion 321, and one side of each of the upper bracket 34 and the lower bracket 35 may be inserted into a space between the front surface portion 321 and the second part 322*b*. Particularly, the upper bracket 34 and the lower bracket 35 may be slidably inserted from upper and lower sides of the mounting member 32 while the light guide plate 33 is mounted on the side surface portion 322.

Here, a height of the stepped portion between the third part 322*c* and the second part 322*b* may correspond to a portion into which the upper bracket 34 and the lower bracket 35 are inserted, that is, a thickness of the upper bracket mounting portion 344 and the lower bracket mounting portion 352*b*. Thus, when the upper bracket 34 and the lower bracket 35 are mounted in the second insertion space 325 while the light guide plate 33 is mounted in the light guide plate insertion space, the upper and lower ends of the light guide plate 33 may be supported by the upper bracket 34 and the lower bracket 35.

A portion of the panel holder 38 may be inserted into the second insertion space 325 between the upper bracket 34 and the lower bracket 35 to fix the panel holder 38. Here, a base insertion portion 381*a* to be described below may be inserted inside the second insertion space 325. That is, a thickness of the base insertion portion 381*a* may correspond to a width of the second insertion space 325 in the forward and backward direction, and the panel holder 38 may be inserted from the side of the second part 322*b* and then be mounted on the mounting member 32.

In addition, a holder restriction groove 326 in which the panel holder 38 is restricted may be defined in an extending end of the second part 322*b*. The holder restriction groove 326 may be defined in the extending end of the second part 322*b* and may be provided in a shape corresponding so that the holder restriction protrusion 382, which will be described below, is inserted.

The holder restriction groove 326 may be disposed at a position corresponding to the mounted position of the panel holder 38. That is, a plurality of holder restriction grooves 326 may be arranged at a set interval along the end of the second part 322*b*. For example, the holder restriction grooves 326 may be respectively defined between the upper bracket 34 and the lower bracket 35 of the side surface portion 322 disposed on each of both the left and right sides of the mounting member 32.

The upper end and the lower end of the side surface portion 322 may be disposed to be stepped with respect to the upper end of the front surface portion 321. Here, the upper end of the front surface portion 321 may protrude further upward than the upper end of the side surface portion 322, and the lower end of the front surface portion 321 may protrude further downward than the lower end of the side surface portion 322.

In detail, an upper protrusion 321*b* and a lower protrusion 321*a*, which protrude further than the upper and lower ends of the side surface portion 322, may be respectively disposed on the upper and lower ends of the front surface portion 321. Thus, the upper bracket 34 and the lower bracket 35 mounted on the upper and lower ends of the mounting member 32 may be assembled with directionality to prevent erroneous assembly, and thus, the upper bracket 34 and the lower bracket 35 may be more firmly fixed and mounted.

That is, when the upper bracket 34 is mounted, both the left and right ends of the upper bracket 34 may be supported on the upper end of the side surface portion 322, and the front end of the upper bracket 34 may be supported on the upper protrusion 321*b*. Thus, the upper bracket 34 may have a structure that is supported by the side surface portion 322 and the front surface portion 321 at the same time and may have a temporary fixing structure even before the screw 399 is coupled. In addition, in a state in which the upper bracket 34 is completely mounted, the upper bracket 34 may be coupled to the front surface portion 321 and the side surface portion 322 to prevent distortion or deformation from occurring.

In addition, when the lower bracket 35 is mounted, both the left and right ends of the lower bracket 35 may be supported by the lower end of the side surface portion 322, and the front end of the lower bracket 35 may be supported by the lower protrusion 321*a*. Thus, the lower bracket 35 may have a structure that is supported by the side surface portion 322 and the front surface portion 321 at the same time.

As described above, the upper bracket 34 and the lower bracket 35 may be inserted into the second insertion space 325 and simultaneously may be seated on the stepped portions of the upper and lower ends of the side surface portion 322 and the front surface portion 321 so as to be firmly coupled to the mounting member 32. The upper bracket 34 and the lower bracket 35 may define top and bottom surfaces of the panel assembly 30 while being coupled to the mounting member 32.

Figure 8:
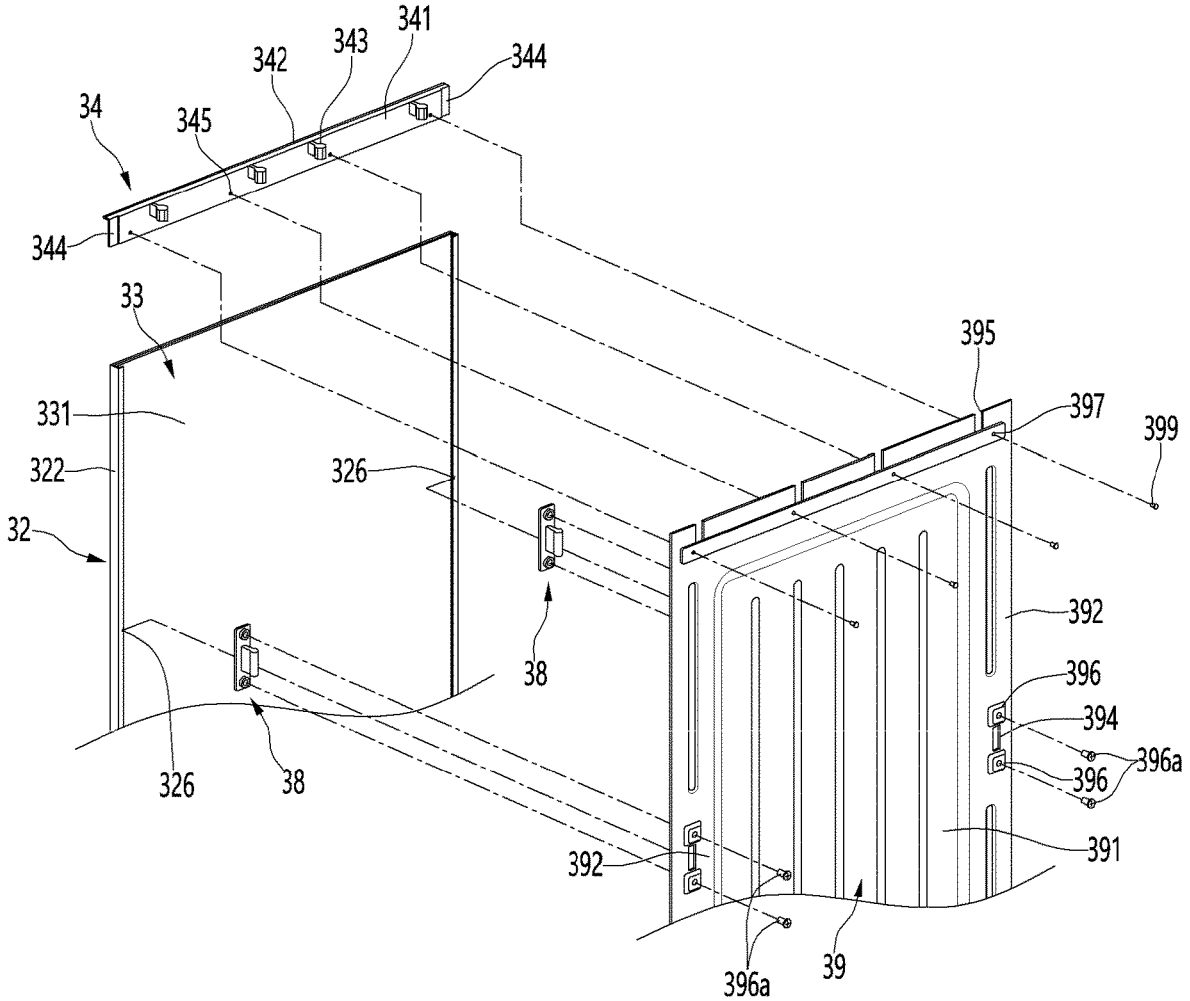
FIG. 8 is an exploded perspective view illustrating a coupling structure of the mounting member, the upper bracket, and the back cover, which constitute the panel assembly.

FIG. 8 is an exploded perspective view illustrating a coupling structure of the mounting member, the upper bracket, and the back cover, which constitute the panel assembly.

As illustrated in the drawings, the upper bracket 34 may have a length corresponding to a length of the panel assembly 30 in a right and left direction. In addition, the upper bracket 34 may define a top surface of the panel assembly 30 in a state of being mounted on the mounting member 32.

In addition, the upper bracket 34 may include an upper bracket extension portion 341 and an upper bracket top surface portion 342 as a whole.

The upper bracket extension portion 341 may be configured to the upper bracket 34 may be disposed in parallel with the panel 31 and the light guide plate 33 to extend in the vertical direction.

In addition, an upper bracket mounting portion 344 disposed to be stepped forward may be disposed on each of both left and right ends of the upper bracket extension portion 341. The upper bracket mounting portion 344 may be disposed to be stepped with respect to the upper bracket extension portion 341 and be disposed in front of the upper bracket extension portion 341.

The upper bracket mounting portion 344 may have a thickness corresponding to a width of the second insertion space 325 and may be slidably inserted upward from a lower portion of the second insertion space 325.

In the state in which the upper bracket 34 is mounted on the mounting member 32, the upper bracket mounting portion 344 may be fixed in the second insertion space 325, and the remaining upper bracket extension portion 341 may be exposed between both the side surface portions 322 to support the upper end of the back cover 39 and to be coupled to the upper end of the back cover 39.

An upper protrusion 343 protruding backward may be disposed on a rear surface of the upper bracket extension portion 341. The upper protrusion 343 may be configured to mount the panel assembly 30 and may protrude from the upper bracket extension portion 341 by a predetermined length to be coupled to an upper mounting portion 431 of the upper cap decoration 43.

In addition, the upper protrusion 343 may protrude from an upper end of the rear surface of the upper bracket extension portion 341 and be provided in plurality at regular intervals along the upper bracket 34. In addition, the upper protrusion 343 may protrude to pass through the protrusion opening 395 of the back cover 39 when the back cover 39 is mounted.

An upper bracket screw hole 345 to be coupled to the screw 399 may be defined in the upper bracket extension portion 341. The upper bracket screw hole 345 may be defined at a position corresponding to the cover screw hole 397. Thus, when the back cover 39 is mounted, the screws 399 may be coupled to sequentially pass through the cover screw hole 397 and the upper bracket screw hole 345.

In addition, the cover opening 394 may be defined in the back cover 39. The cover opening 394 may be opened at a position corresponding to the panel holder 38 and may have a size so that a portion of the panel holder 38 protruding to be coupled to the holder case 48 passes.

In addition, a holder mounting portion 396 may be disposed above and below the cover opening 394, and a screw 396*a* may be coupled to the holder mounting portion 396. The holder mounting portion 396 may be formed to protrude rearward, and thus, a boss 383 of the panel holder 38 may be accommodated therein. Thus, the screw 396*a* coupled to pass through the holder mounting portion 396 may be coupled to the boss 383 so that the panel holder 38 is firmly fixed to the back cover 39. Thus, the panel holder 38 may have a structure that is doubly restricted with the mounting member 32 and the back cover 39 and may stably support the heavy panel holder 38.

In addition, a plurality of cover openings 394 and holder mounting portions 396 may be disposed along both the left and right ends of the back cover 39.

The upper bracket top surface portion 342 may be disposed on an upper end of the upper bracket extension portion 341. The upper bracket top surface portion 342 may define the top surface of the panel assembly 30 and may extend in a direction perpendicular to the upper bracket extension portion 341.

The upper bracket top surface portion 342 may extend forward from the upper end of the upper bracket extension portion 341. The front end of the upper bracket top surface portion 342 may support the upper end of the panel 31 and completely shield the upper ends of the mounting member 32 and the light guide plate 33.

Thus, the upper bracket 34 may be fixedly coupled to the upper end of the mounting member 32 and be in the state of being coupled to the back cover 39 by the screw 399 to restrain upward movement of the light guide plate 33 and define a shape of the top surface of the panel assembly 30.

Figure 9:
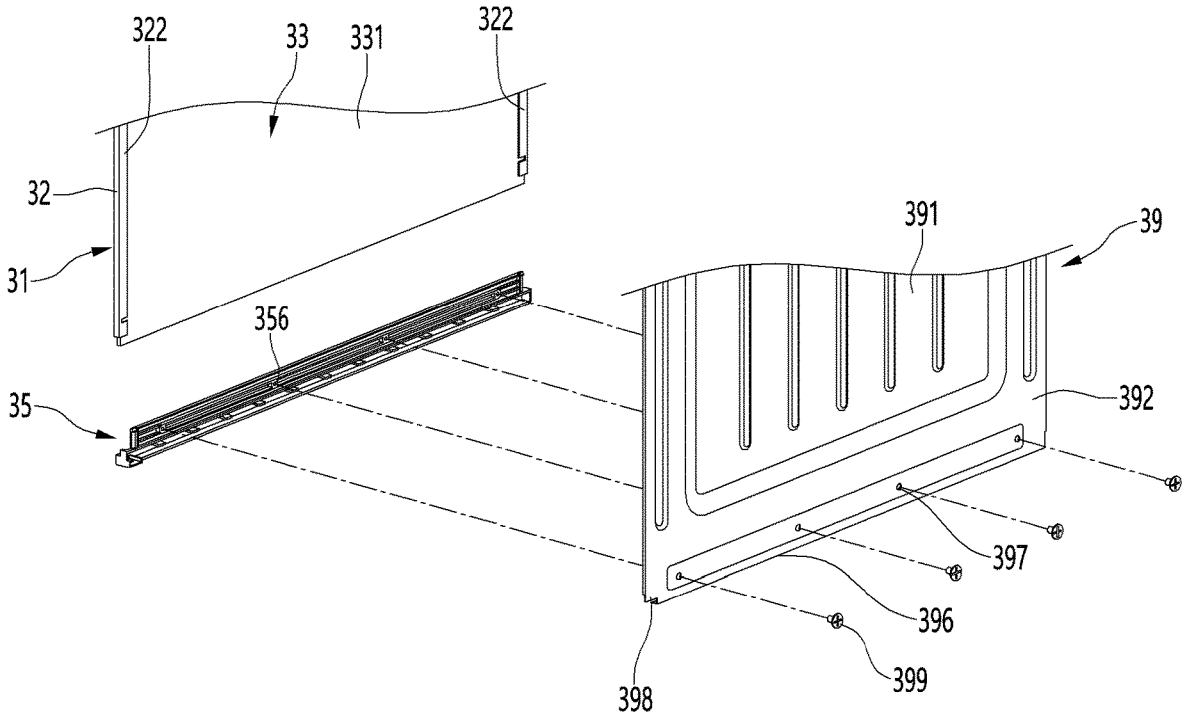
FIG. 9 is an exploded perspective view illustrating a coupling structure of the mounting member, the lower bracket, and the back cover, which constitute the panel assembly.
Figure 10:
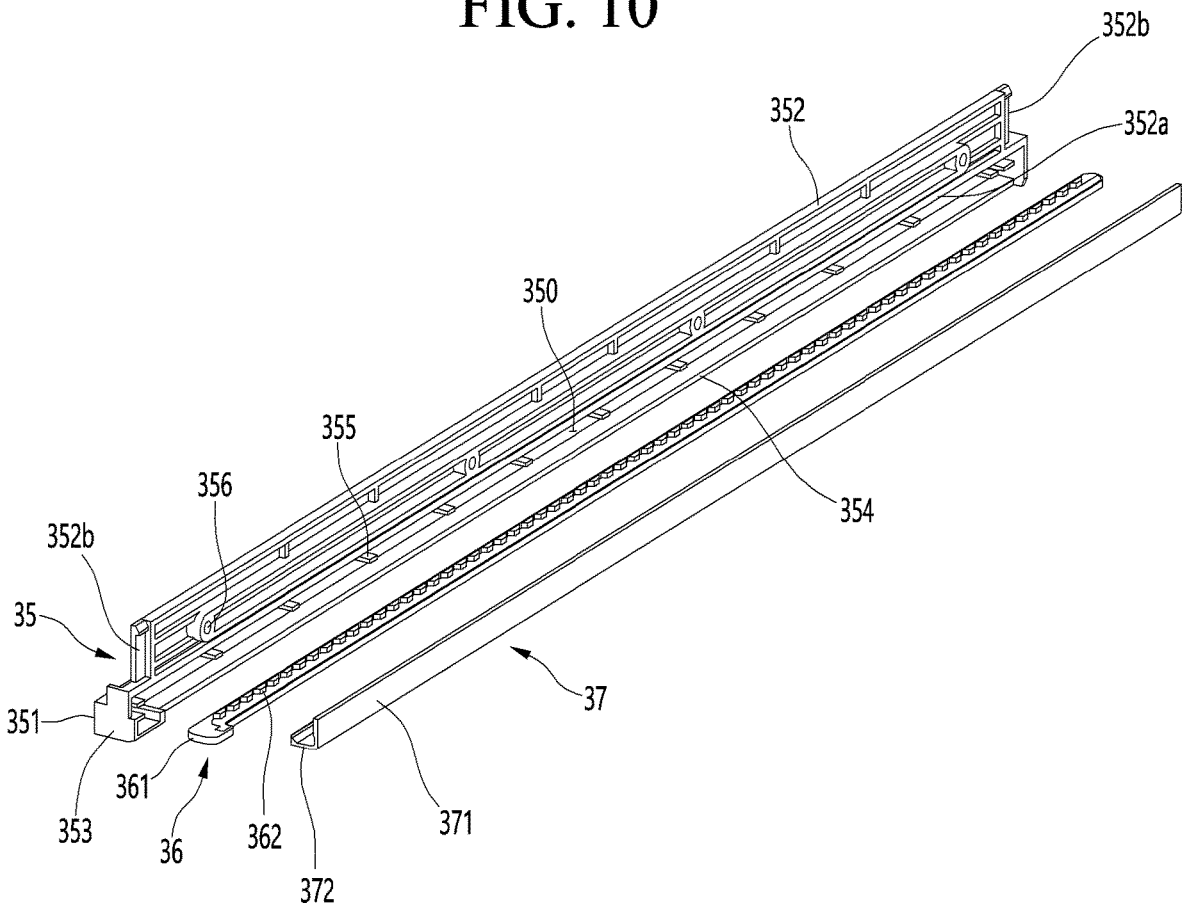
FIG. 10 is an exploded perspective view illustrating a coupling structure of the lower bracket and a lighting device.

FIG. 9 is an exploded perspective view illustrating a coupling structure of the mounting member, the lower bracket, and the back cover, which constitute the panel assembly. Also, FIG. 10 is an exploded perspective view illustrating a coupling structure of the lower bracket and a lighting device.

As illustrated in the drawings, the lower bracket 35 may have a corresponding to the right and left direction length of the panel assembly 30. The lower bracket 35 may broadly include the lower bracket front surface portion 351, a lower bracket rear surface portion 352, a lower bracket side surface portion 353, and a lower bracket bottom surface portion 354.

The lower bracket front surface portion 351 may define a shape of the front surface of the lower bracket 35, and a panel support portion (reference numeral 351*a* in FIG. 18) may be disposed on the upper end of the lower bracket front surface portion 351 to define the lower end of the panel 31.

That is, the panel support portion 351*a* may protrude more upward than an upper end of a light source of the lighting device 36 and may protrude to a set height to prevent the lighting device 36 from being exposed forward. The panel support portion 351*a* may hide an area generated due to intensive light irradiation at the lower end of the light guide plate 33 and the lower end of the panel 31, which are disposed more adjacent to the lighting device 36, to prevent a lighting spot from being formed on the panel 31.

The lower bracket rear surface portion 352 may define a rear surface of the lower bracket 35 and may protrude more upward than the lower bracket front surface portion 351 and the lower bracket side surface portion 353 to support the light guide plate 33 at the rear side and then may be coupled to the back cover 39.

A lower bracket mounting portion 352*b* that is disposed to be stepped forward may be disposed on each of both left and right ends of the lower bracket rear surface portion 352. The lower bracket mounting portion 352*b* may be slidably inserted upward from a lower side of the second insertion space 325. In addition, one end of the lower bracket mounting portion 352*b* may be cut off, and an end of the lower bracket mounting portion 352*b* may be provided in a hook shape so that the lower bracket mounting portion 352*b* is hooked and restricted inside the second insertion space 325 when the lower bracket 35 is mounted.

A lower bracket screw hole 356 to which a plurality of screws 399 are coupled may be defined in the lower bracket rear surface portion 352. The lower bracket screw hole 356 may be defined at a position corresponding to a cover screw hole 397, and when the back cover 39 is mounted, the screw 399 may sequentially pass through the cover screw hole 397 and the lower bracket screw hole 356 and then be coupled.

A bracket opening may be defined in the lower bracket rear surface portion 352. The bracket opening 352*a* may be defined at a position facing the lower bracket front surface portion 351 and may be defined to be opened in the rear surface of an accommodation space 350 in which the lighting device 36 is mounted. In addition, the lighting device 36 may be accessible through the bracket opening 352*a*. The bracket opening 352*a* may be shielded by the back cover 39.

The lower bracket bottom surface portion 354 may define a bottom surface of the lower bracket 35 and may define a bottom surface of the space in which the lighting device 36 is mounted. A light guide plate support portion 355 protruding rearward may be disposed on the lower bracket front surface portion 351. The plurality of light guide plate supports 355 may protrude backward at a constant interval along the lower bracket front surface portion 351.

In this case, the light guide plate support portion 355 may extend to restrain the lighting device 36 at the upper side. The light guide plate support portion 355 and the lower bracket bottom surface portion 354 may restrain the lighting device 36 at the upper and lower sides to restrain upward and downward movement of the lighting device 36. In addition, a top surface of the light guide plate support portion 355 may support a lower end of the light guide plate 33.

The lighting device 36 may be provided within the lower bracket 35. The lighting device 36 may include a substrate 361 and a light source 362. The substrate 361 may be formed in a plate shape to be accommodated within the lower bracket 35 and may extend from one end of the lower bracket 35 to the other end. The plurality of light sources 362 may be arranged at a constant interval on the substrate 361.

The light source 362 may be disposed to emit light toward the lower end of the light guide plate 33. The light source 362 may be disposed to emit light toward the lower end of the light guide plate 33. The left side end and the right side end of the substrate 361 may be in contact with the lower bracket side surface portion 353 within the lower bracket 35 and may restrain right and left movement.

An example of the light source 362 may include an LED. The light source 362 may include an RGB LED for emitting light with various colors under control of the controller 13. That is, the light source 362 may emit light with various colors under control of the controller 13, and thus the panel 31 may shine with color set by the controller 13, According to color of the panel 31, a color of the outer appearance of the front surface of the refrigerator 1 may be determined.

The light source 362 may include an LED emitting light with specific color other than the RGB LED and may include a combination of a plurality of LEDs emitting light with different colors.

A light supporter 37 may be provided within the lower bracket 35. The light supporter 37 may support the lighting device 36 within the lower bracket 35.

In addition, the light supporter 37 may be made of a metal material to dissipate heat generated by the lighting device 36 by conduction and may be provided in a size that is enough to be accessible through the bracket opening 352*a*.

The light supporter 37 may include a first supporting portion 372 supporting the lighting device 36 and a second supporting portion 371 that is in contact with the back cover 39. The first supporting portion 372 may be disposed on the lower bracket bottom surface portion 354 within the lower bracket 35. The second supporting portion 371 may extend upward from a rear end of the first supporting portion 372 and be exposed backward through the bracket opening 352*a* so that when the back cover 39 is mounted, the second supporting portion 371 is in contact with the back cover 39. Thus, the heat generated by the lighting device 36 may be transferred to the back cover 39 through the light supporter 37 so as to be dissipated.

Hereinafter, a structure of the panel holder 38 will be described in more detail with reference to the drawings.

Figure 11:
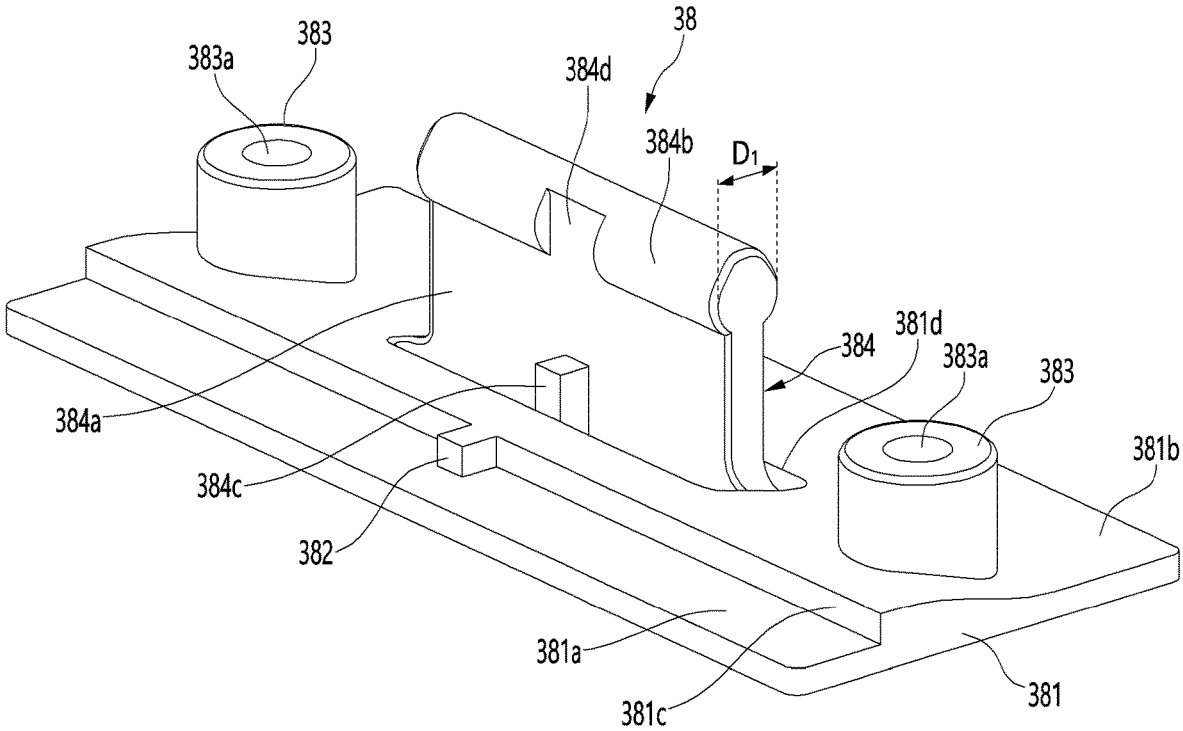
FIG. 11 is a perspective view illustrating the panel holder according to an embodiment.
Figure 12:
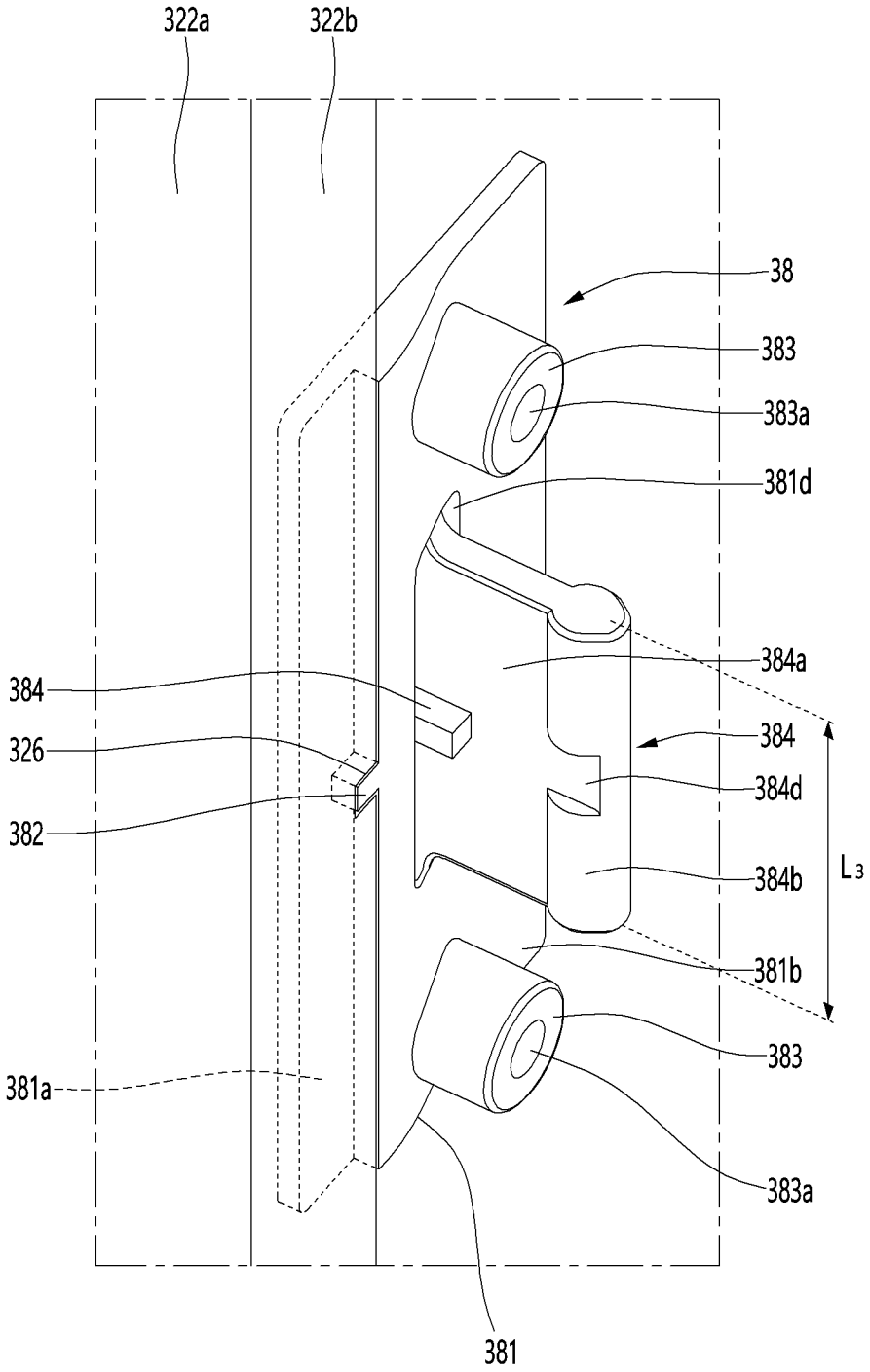
FIG. 12 is a perspective view illustrating a state in which the panel holder is mounted to the mounting member.
Figure 13:
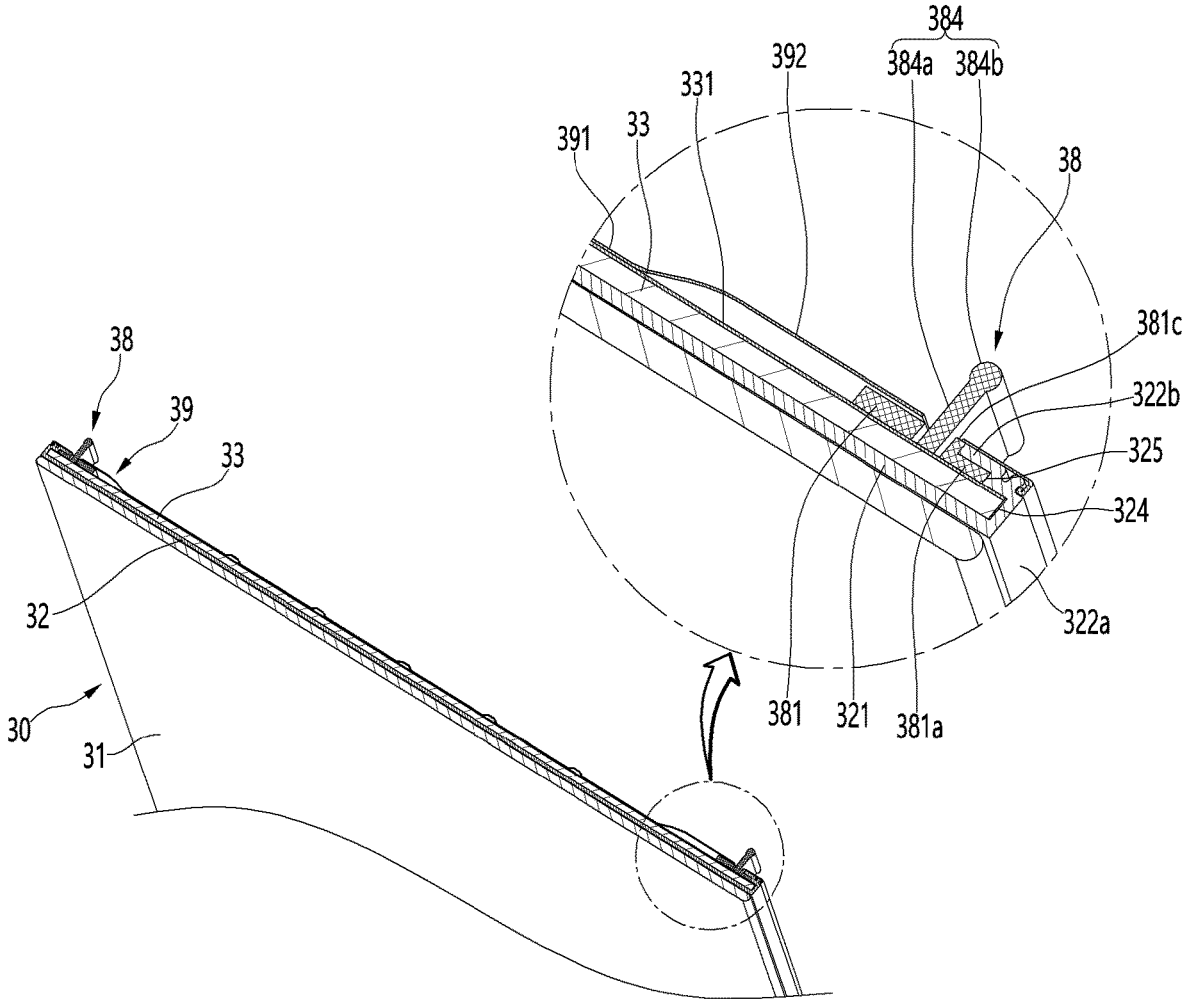
FIG. 13 is a cutaway perspective view taken along line XIII-XIII' of FIG. 4.
Figure 14:
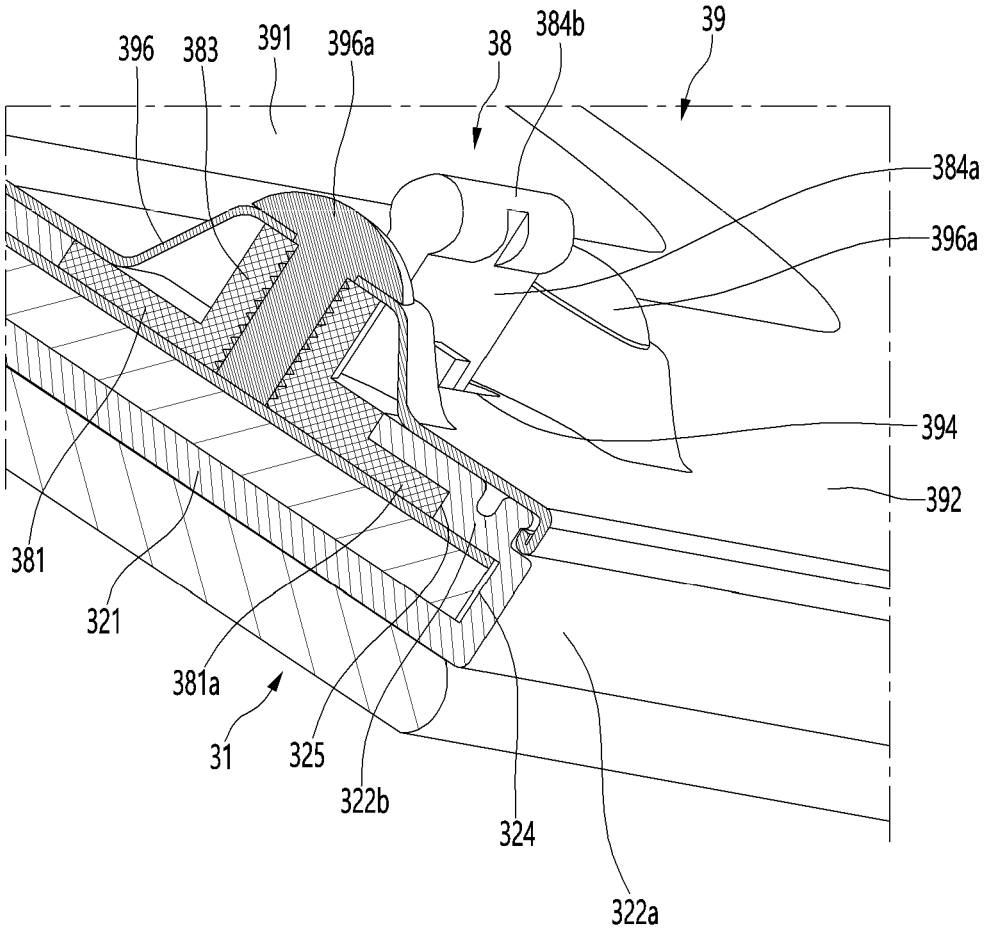
FIG. 14 is a cutaway perspective view taken along line XIV-XIV' of FIG. 4.

FIG. 11 is a perspective view illustrating the panel holder according to an embodiment. Also, FIG. 12 is a perspective view illustrating a state in which the panel holder is mounted to the mounting member. Also, FIG. 13 is a cutaway perspective view taken along line XIII-XIII' of FIG. 4. Also, FIG. 14 is a cutaway perspective view taken along line XIV-XIV' of FIG. 4.

As illustrated in the drawings, the panel holder 38 may be injection-molded as a whole using a plastic material or may be molded as a single member. Of course, the panel holder 38 may be made of a metal or other material having sufficient strength and durability.

In addition, the panel holder 38 may be mounted on the mounting member 32 and include a base 381 disposed inside the panel assembly 30 and a holder protrusion 384 protruding from the base 381 to pass through the back cover 39 so as to be coupled to the holder case 48.

The base 381 may be in contact with the rear surface of the light guide plate 33 when the one surface (front surface when viewed in FIG. 12) of the base 381 is provided in a planar surface so that the mounting member 32 is mounted thereon. In addition, the holder protrusion 384 may protrude backward from an opposite surface (rear side when viewed in FIG. 12) that is in contact with the light guide plate 33.

The base 381 may include a base insertion portion 381*a*. The base insertion portion 381*a* may define one end of the base 381 and may be inserted into the second insertion space 325 of the mounting member 32. The base insertion portion 381*a* may extend from an upper end to a lower end of the base 381 and may define the entire one end of the base 381. In addition, the base insertion portion 381*a* may be disposed to be stepped with respect to other portions of the base 381 and may have a thickness corresponding to a width of the second insertion space 325 in the front and rear direction. That is, the thickness of the base insertion portion 381*a* may correspond to a distance from the rear surface of the light guide plate 33 to the second part 322*b* in the state in which the light guide plate 33 is mounted in the first insertion space 324.

In addition, the holder restriction protrusion 382 may protrude from an approximately intermediate point of the base insertion portion 381*a*. The holder restriction protrusion 382 may have a size corresponding to a position corresponding to the holder restriction groove 326. Thus, when the base insertion portion 381*a* is inserted into the second insertion space 325, the holder restriction protrusion 382 may be inserted into the holder restriction groove 326, and the panel holder 38 may be primarily fixed at an accurate position.

The base 381 may include a base exposed portion 381*b*. The base exposed portion 381*b* may define a portion exposed to the outside of the second part 322*b* while the panel holder 38 is mounted on the mounting member 32. The base exposed portion 381*b* may define a remaining portion of the base 381 excluding the base insertion portion 381*a*. In addition, a base stepped portion 381*c* disposed to be stepped may be disposed at a boundary between the base insertion portion 381*a* and the base exposed portion 381*b*. The base stepped portion 381*c* may have a height corresponding to a thickness of the end of the second part 322*b* and may be in close contact with the end of the second part 322*b* when the panel holder 38 is mounted.

In addition, at least a portion from the end of the base exposed portion 381*b* that is in contact with the second part 322*b* to an outer end of the base exposed portion 381*b* may be inclined or rounded to be gradually lowered. The holder protrusion 384 and the boss 383 may be disposed on the base exposed portion 381*b*.

In detail, a base opening 381*d* passing through a center of the base 381 may be defined in the base 381, and the holder protrusion 384 may extend backward inside the base opening 381*d*.

The base opening 381*d* may be configured to dispose a mold during the injection molding of the panel holder 38 and may be opened to mold a shape of the holder protrusion 384. The panel holder 38 may be disposed inside the base opening 381*d*, and the holder protrusion 384 and the inner surface of the base opening 381*d* may be connected to each other by a connection rib 384*c*. The connection ribs 384*c* may be disposed on left and right surfaces of the holder protrusion 384.

A vertical length L3 of the holder protrusion 384 may be slightly less than a vertical length L1 of each of the cover opening 394 and the plate opening 411. In addition, the vertical length L3 of the holder protrusion 384 may be less than a vertical length L4 of a holder accommodation space 482*a* to be described below. Thus, when the panel assembly 30 is mounted, the holder protrusion 384 may pass through the plate opening 411 and then be inserted into the holder accommodation space 482*a*.

In addition, the holder protrusion 384 may include a holder extension portion 384*a* extending backward and a holder hook portion 384*b* disposed on an end of the holder extension portion 384*a*. The holder extension portion 384*a* may extend inside the base opening 381*d* and have a predetermined thickness. Here, the holder extension portion 384*a* may have a thickness less than a thickness D1 of the holder hook portion 384*b*. In addition, the holder extension portion 384*a* may have a thickness equal to or slightly less than an interval D2 from a case hook portions 486*b* to be described below. In addition, a lower end of the holder extension portion 384*a* may be connected to an inner surface of the base opening 381*d* by the connection rib 384*c*.

The holder hook portion 384*b* may be disposed on an upper end of the holder extension portion 384*a* and serve as a substantial hook restriction inside the holder case 48. The holder hook portion 384*b* may have a circular or elliptical cross-section to facilitate the insertion into and the restriction of the holder case 48. Here, the thickness D1 of the thickest cross-section of the holder hook portion 384*b* may be greater than the thickness of the holder extension portion 384*a* and may be greater than a distance D2 from the case hook portion 486*b*.

An outer surface of the holder hook portion 384*b* may be provided in an inclined or rounded shape. In addition, a groove 384*d* may be defined at an intermediate point in the vertical direction of the holder hook portion 384*b*. The groove 384*d* may be defined in the same extension line as the connection rib 384*c*. The groove 384*d* may be provided to move the mold when the connection rib 384*c* and the holder protrusion 384 are molded.

A boss 383 may be disposed on each of upper and lower portions of the base 381. The boss 383 may be provided above and below the holder protrusion 384 and may protrude backward from the base exposed portion 381*b*. The boss 383 may be inserted into the holder mounting portion 396 and may protrude so that an inner surface of the holder mounting portion 396 is supported. In addition, a screw hole 383*a* through which a screw 396*a* passing through the holder mounting portion 396 is coupled may be defined in a rear surface of the boss 383.

Referring to the coupled state of the panel holder 38 in more detail with reference to FIGS. 13 and 14, the panel holder 38 may be fixedly mounted on the mounting member 32. The base insertion portion 381*a* of the panel holder 38 may be inserted into the second insertion space 325. Here, a front surface of the base 381 may be in a state of being in close contact with the rear surface of the light guide plate 33, and the front surface of the base 381 may be restricted by the second part 322*b* of the side surface portion 322. That is, the panel holder 38 may be primarily fixed while being inserted into the mounting member 32 and thus may be restricted in movement in the forward and backward direction. Here, the panel holder 38 may be fixed at an accurate position by the coupling between the holder restriction protrusion 382 and the holder restriction groove 326.

In addition, the panel holder 38 may be fixed to the back cover 39 by mounting the back cover 39. When the back cover 39 is mounted, the holder protrusion 384 may protrude backward through the cover opening 394. Here, the boss 383 may be supported on an inner surface of the holder mounting portion 396. In this state, a screw 396*a* may pass through the holder mounting portion 396 and then be coupled to the boss 383, and the upper and lower portions of the panel holder 38 may be firmly coupled to the back cover 39 and thus be secondarily fixed. In particular, the panel holder 38 and the back cover 39 may be coupled to each other to restrict movement of the panel holder in the forward and backward direction and in the vertical direction.

In addition, in the state in which the back cover 39 is coupled, the cover circumferential portion 392 of the back cover 39 may be in contact with the rear surface of the base 381 to additionally restrict the movement of the panel holder 38 in the forward and backward direction. Due to such the double fixing structure, the heavy panel assembly 30 may be firmly coupled to the door body 40, and in particular, both the left and right ends of the panel assembly 30 may be maintained in the state of being in close contact with the door body 40 without being lifted.

Hereinafter, the holder case 48 will be described in more detail with reference to the accompanying drawings.

Figure 15:
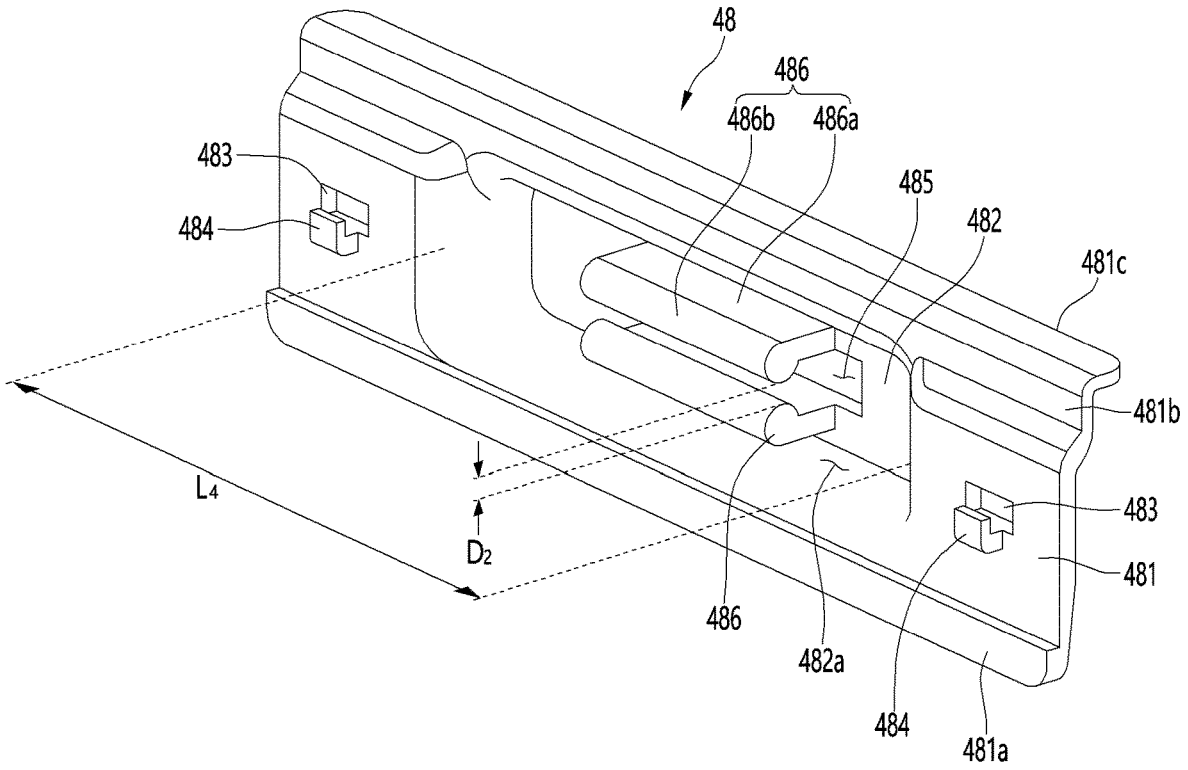
FIG. 15 is a front perspective view illustrating the holder case according to an embodiment.
Figure 16:
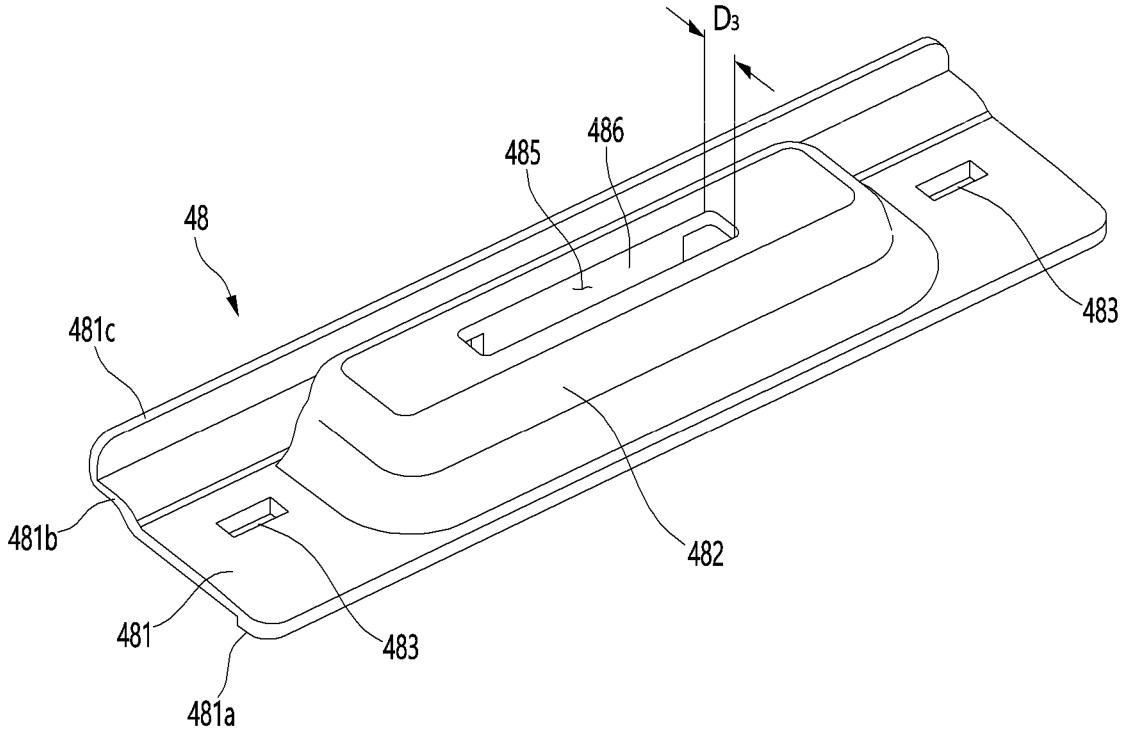
FIG. 16 is a rear perspective view illustrating the holder case.

FIG. 15 is a front perspective view illustrating the holder case according to an embodiment. Also, FIG. 16 is a rear perspective view illustrating the holder case.

As illustrated in the drawings, the holder case 48 may be injection-molded using a plastic material, and the entire holder case 48 may be provided as a single component. Of course, if the holder case 48 has the same shape, the holder case 48 may be made of a metal or other materials.

The holder case 48 may be mounted on the rear surface of the body plate 41 and may be mounted at a position corresponding to the plate opening 411. Thus, when the panel assembly 30 is mounted, the panel assembly 30 may be disposed at a position coupled to the panel holder 38.

The holder case 48 may include a plate-shaped case body 481 that is in close contact with the body plate 41. In addition, a holder accommodation space 482*a* recessed backward may be defined in a substantially central portion of the case body 481. The holder accommodation space 482*a* may have a size that is enough to accommodate the panel holder 38 for coupling. In addition, the holder accommodation space 482*a* may be referred to as a holder accommodation portion.

In detail, a vertical length L4 of the holder accommodation space 482*a* may be greater than a vertical distance L2 up to each end of the holder mounting portion 396 disposed above and below the holder protrusion 384. Thus, when the panel assembly 30 is mounted, the holder protrusion 384 as well as the holder mounting portion 396 disposed vertically may be inserted into the holder accommodation space 482*a*. Due to such an insertion structure, the rear surface of the panel assembly 30, that is, the back cover 39 may be in close contact with the body plate 41 to minimize an increase in volume of the door 20.

In addition, the holder accommodation space 482*a* may be recessed to a depth into which the holder protrusion 384 and the holder mounting portion 396 are completely inserted. In addition, a recessed bottom surface 482 of the holder accommodation space 482*a* may be provided in a planar shape parallel to the case body 481. In addition, a pair of case restriction portions 486 extending forward may be disposed on the bottom surface 482. The case restriction portion 486 may be configured to so that the holder protrusion 384 is inserted and coupled, and the pair of case restriction portions 486 may be spaced apart from each other.

In addition, the case opening 485 may be defined in a center of the bottom surface 482, and the case restriction portion 486 may extend along both ends of the bottom surface 482. A protruding height of the case restriction portion 486 may not protrude more than the most front end of the holder case 48 and may be disposed behind the plate opening 411. That is, the case restriction portion 486 may be disposed in an inner space of the door body 40, which is filled with the insulator 400, and the case restriction portion 486 may be exposed through the plate opening 411.

The case restriction portion 486 may be disposed at a position corresponding to the plate opening 411, and a space between the end extending to the plate opening 411 and the plate opening 411 may be exposed.

In addition, the case restriction portion 486 may include a case extension portion 486*a* protruding from the bottom surface 482 and a case hook portion 486*b* disposed at an end of the case extension portion 486*a*. The case extension portion 486*a* may be provided in a rib shape having a predetermined thickness and may extend from an end of the case opening 485.

The case hook portion 486*b* may be disposed along the end of the case extension portion 486*a* and may define a protruding front end of the case restriction portion 486. The case hook portion 486*b* may have an inclined or rounded outer surface to facilitate the insertion of the holder protrusion 384. For example, the case hook portion 486*b* may have a curved surface in a circular or elliptical cross-section, and a curved surface may be defined on a surface facing the pair of the case hook portions 486*b*.

A thickness of the thickest portion of the case hook portion 486*b* may be greater than that of the case extension portion 486*a* and may protrude into a space between the case extension portions 486*a*. In addition, a distance D2 between the pair of case hook portions 486*b* may be less than a thickness D1 of the holder hook portion 384*b*. In addition, a distance D3 between the pair of case extension portions 486*a* may be greater than the thickness D1 of the holder hook portion 384*b*. That is, when the panel assembly 30 is mounted, the holder hook portion 384*b* may pass while pressing the case hook portion 486*b* and may be inserted and restricted between the case extension portions 486*a*.

A case fixing portion 484 configured to fix and mount the holder case 48 may be disposed on each of upper and lower portions of the case body 481. The case fixing portion 484 may be disposed at a position corresponding to the case fixing hole 412 defined in the body plate 41 and have a hook-like shape so as to be hooked in the case fixing hole 412. That is, when the holder case 48 is mounted on the rear surface of the body plate 41, the case fixing portion 484 may be hooked by an end of the case fixing hole 412. In addition, a fixing portion hole 483 may be defined in the case body 481 corresponding to the case fixing portion 484. When the holder case 48 is injection-molded by the fixing portion hole 483, the case fixing portion 484 may be molded.

A first case support portion 481*a* supported on the rear surface of the body plate 41 may be disposed on one end of the case body 481. The first case support portion 481*a* may be disposed along a side end of the case body 481 and may protrude forward. That is, the first case support portion 481*a* may be disposed to be stepped on the front surface of the case body 481.

In addition, second case support portions 481*b* and 481*c* may be disposed on the other end of the case body 481, which is opposite to the first case support portion 481*a*. The second case support portions 481*b* and 481*c* may be provided in a multi-stage bent shape and may be in contact with one inner side surface of the door body 40.

The second case support portions 481*b* and 481*c* may define one end of the case body 481 and include a front surface support portion 481*b* disposed to be stepped backward and a side surface support portion 481*c* bent backward from the extending end of the front surface support portion 481*b*. The front surface support portion 481*b* and the side support portion 481*c* may be supported by the side decoration 44 inside the door body 40.

Hereinafter, the coupling structure of the panel holder 38 and the holder case 48 will be described in more detail with reference to the drawings.

Figure 17:
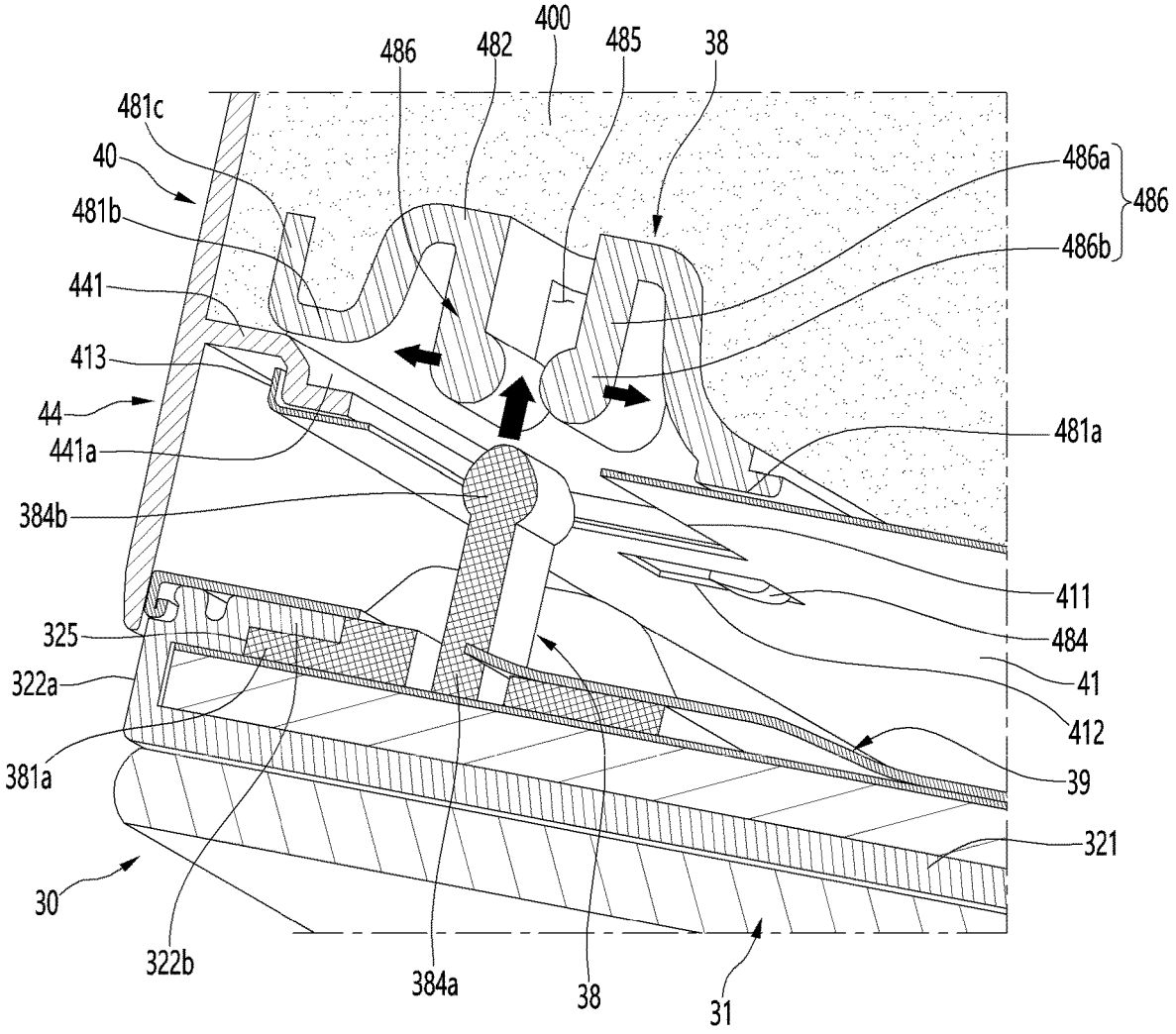
FIG. 17 is a cutaway perspective view illustrating a state before the panel assembly and the door body are coupled to each other.
Figure 18:
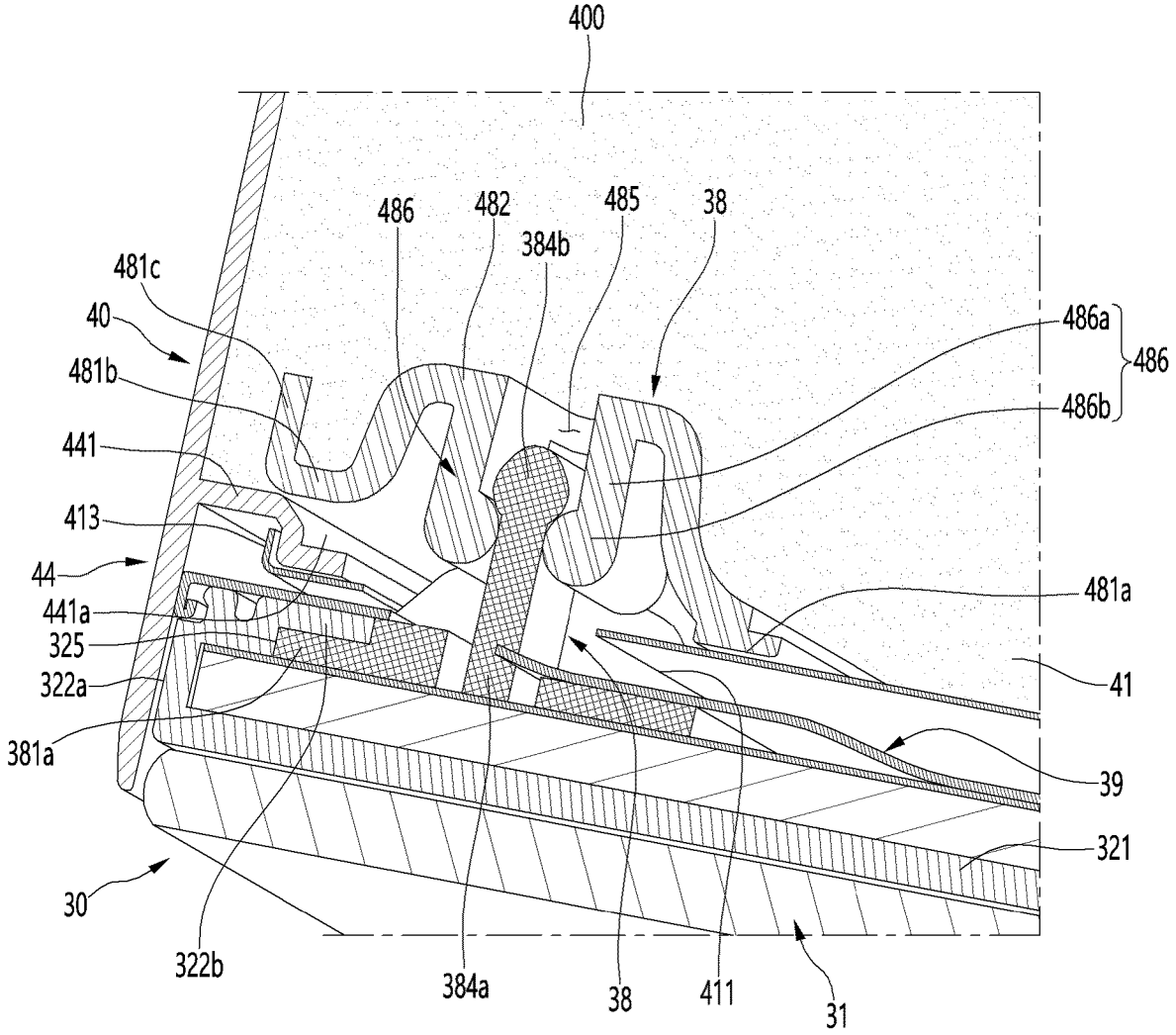
FIG. 18 is a cutaway perspective view illustrating a state after the panel assembly and the door body are coupled to each other.
Figure 19:
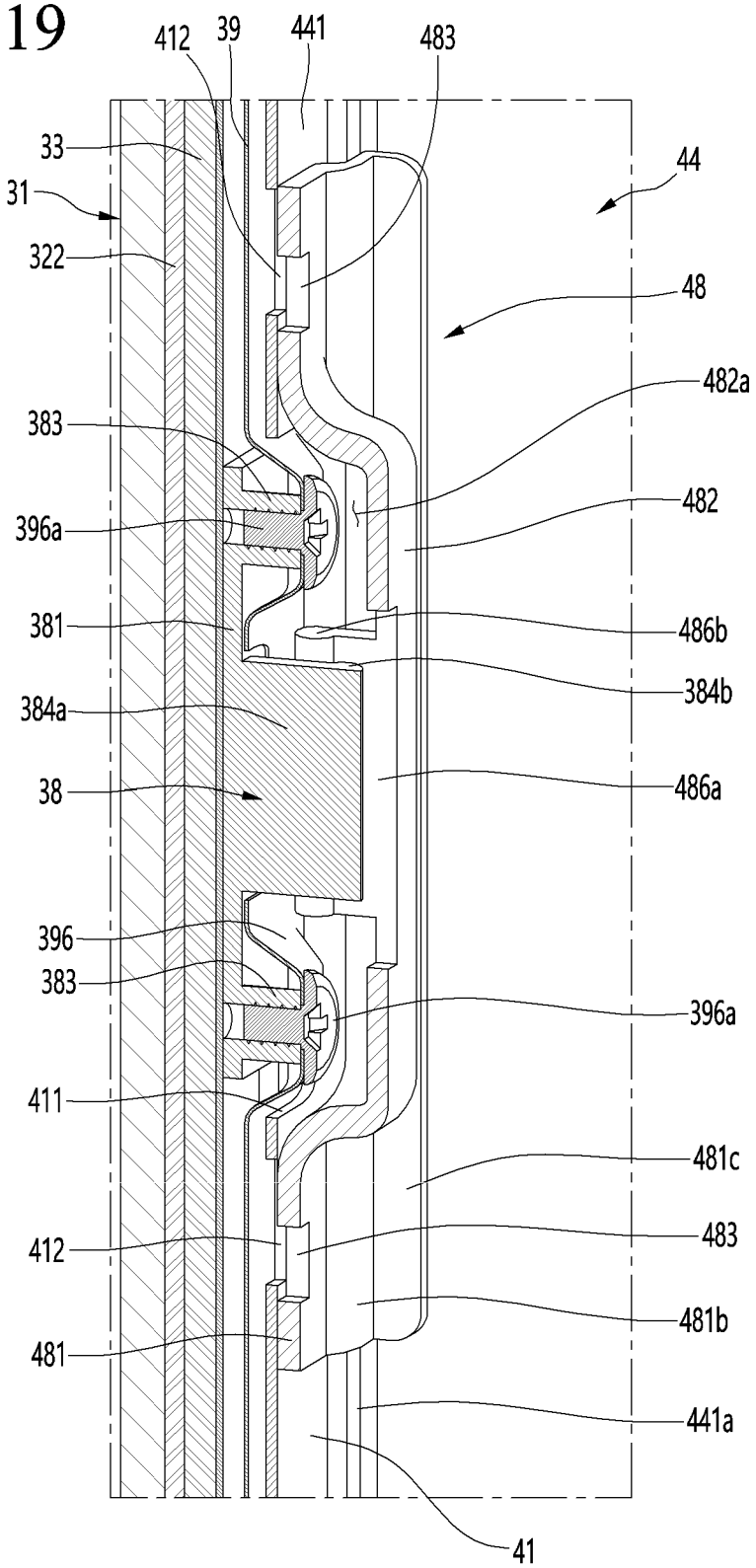
FIG. 19 is a cutaway perspective view taken along line XIX-XIX' of FIG. 3.

FIG. 17 is a cutaway perspective view illustrating a state before the panel assembly and the door body are coupled to each other. Also, FIG. 18 is a cutaway perspective view illustrating a state after the panel assembly and the door body are coupled to each other. Also, FIG. 19 is a cutaway perspective view taken along line XIX-XIX' of FIG. 3.

As illustrated in the drawings, before the panel assembly 30 is mounted on the door body 40, the panel holder and the holder case 48 may be separated from each other as illustrated in FIG. 17.

Here, the panel holder 38 may be in a state in which the holder mounting portion 396 protrudes backward, and the holder case 48 may be in a state of being mounted inside the door body 40. In addition, the case restriction portion 486 coupled to the holder protrusion 384 may be exposed through the plate opening 411.

The holder case 48 may be maintained in a state of being coupled to the rear surface of the body plate 41 and may be in close contact with the body plate 41 by an insulator 400. In addition, the case fixing portion 484 may be locked while being inserted into the case fixing hole 412. Here, the first case support portion 481*a* may closely support the rear surface of the body plate 41.

The second case support portions 481*b* and 481*c* may be supported by an inner surface of the side decoration 44. Decoration supporting portions 441 and 441*a* protruding inward along the side surface of the side decoration 44 may be disposed on the side decoration 44, and the ends of the decoration supporting portions 441 and 441*a* may be coupled to a side end of the body plate 41.

In detail, the door body 40 may be divided into a space, which is filled with the insulator, and a space, in which the panel assembly 30 is accommodated and mounted, by the combination of the decoration supporting portions 441 and 441*a* and the body plate 41.

In addition, the decoration supporting portions 441 and 441*a* may include a first supporting portion 441 extending from the inner surface of the side decoration 44 and a second supporting portion 441*a* extending in a stepped state from the first supporting portion 441.

The first supporting portion 441 may support the second case support portions 481*b* and 481*c* of the holder case 48. Here, the first supporting portion 441 may be in contact with the front surface support portion 481*b* of the second case support portions 481*b* and 481*c*, and the side surface of the side decoration 44 and the side support portion 481*c* may be in contact with each other. Thus, one end of the holder case 48 may be stably supported by the side decoration 44.

In addition, the second supporting portion 441*a* may support an end of the body plate 41. Here, a bent side end of the body plate 41 may be seated on the stepped ends of the first supporting portion 441 and the second supporting portion 441*a*.

As described above, in a state in which the holder case 48 is firmly coupled to the inside of the door body 40, the panel assembly 30 may be mounted on the front surface of the door body 40. Here, when the holder protrusion 384 of the panel assembly 30 moves backward to match the plate opening 411, the holder protrusion 384 may be inserted into the pair of case restriction portions 486.

Here, the front end of the case restriction portion 486, that is, the case hook portion 486*b* may be in contact with the rear end of the holder protrusion 384, that is, the holder hook portion 384*b*, and the pair of case extension portions 486*a* may be elastically deformed outward while the holder protrusion 384 is press-fitted between the pair of case restriction portions 486.

Then, when the panel assembly 30 completely moves backward toward the front surface of the door body 40, as illustrated in FIG. 18, the holder protrusion 384 is completely inserted into the holder case 48.

Here, the holder hook portion 384*b* may pass through the case hook portion 486*b* and then be disposed between the case extension portions 486*a*, and the holder hook portion 384*b* and the case hook portion 486*b* may be in a state of being hooked with each other. In addition, not only the holder protrusion 384 but also the protruding portion of the holder mounting portion 396 may pass through the plate opening 411 and be inserted into the holder accommodation space 482*a*.

Thus, the rear surface of the panel assembly 30, that is, the back cover 39 may be in contact with or adjacent to the front surface of the door body 40, that is, the front surface of the body plate 41. In addition, the upper protrusion 343 and the lower protrusion 473 may also be coupled to the upper mounting portion 431 and the lower mounting portion 451 of the door body 40, and thus, an entire circumference of the panel assembly 30 may be in a state of being fixed to the door body 40.

In the case in which the panel assembly 30 is to be separated, when the panel assembly 30 is strongly pulled forward after releasing the screw 475 coupled to the lower protrusion 473, the holder protrusion 384 may be separated from the holder case 48.

Hereinafter, the operations of the refrigerator 1 and the panel assembly 30 having the above structures will be described in more detail with reference to the drawings.

Figure 20:
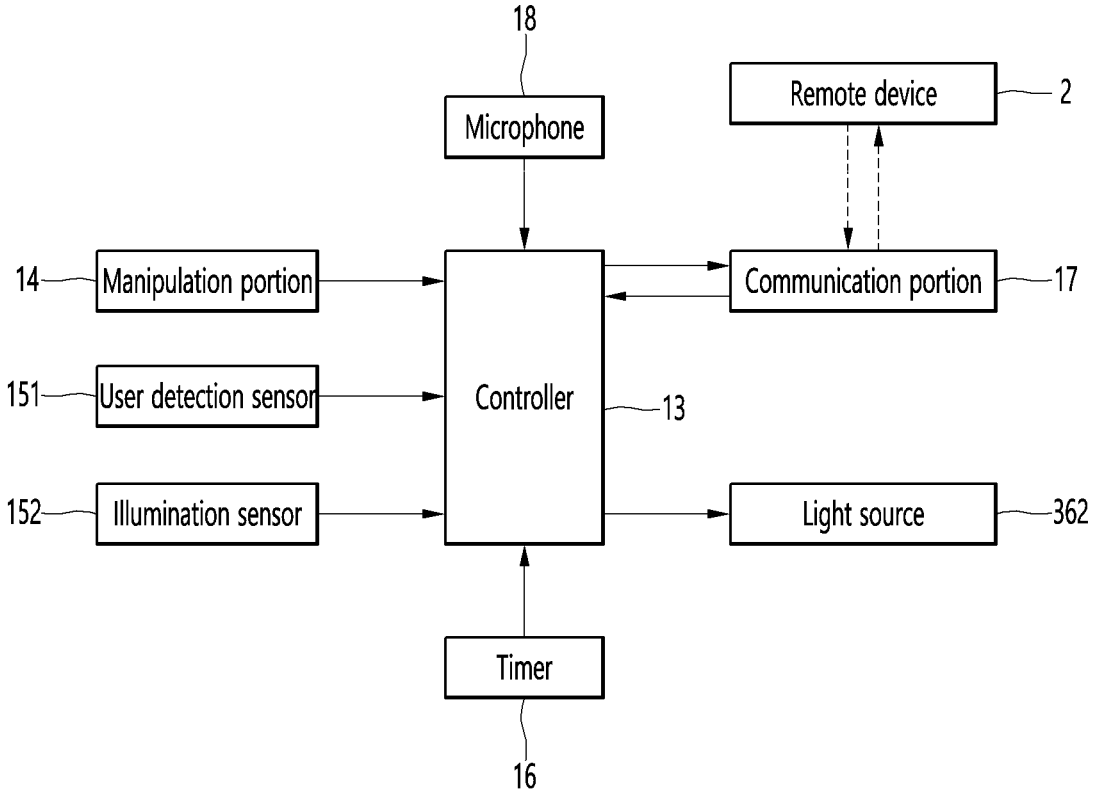
FIG. 20 is a block diagram illustrating a flow of a control signal of the refrigerator.
Figure 22:
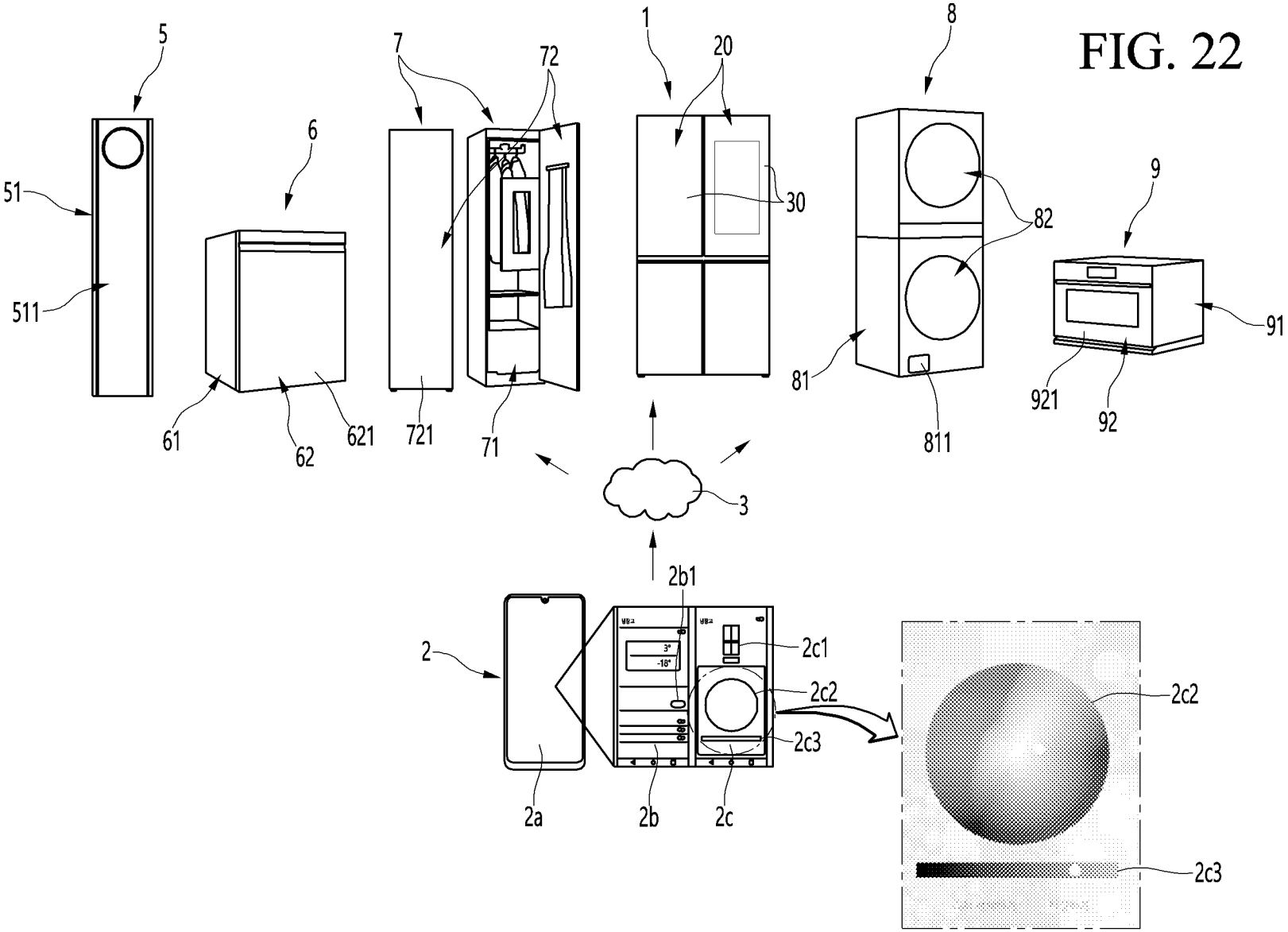
FIG. 22 is a view illustrating an example of adjusting colors of home appliances to which the panel assembly using a remote device is applied.

FIG. 20 is a block diagram illustrating a flow of a control signal of the refrigerator. Also, FIG. 21 is a vertical cross-sectional view illustrating an emission state of the panel assembly. Also, FIG. 22 is a view illustrating an example of adjusting colors of home appliances to which the panel assembly using a remote device is applied.

As illustrated in the drawing, an outer appearance of the home appliance according to an embodiment may be defined by the panel assembly 30, and also, a color of the outer appearance of the home appliance may be changed to a color that is set by the user according to the operation of the lighting device 36. The panel assembly may be expressed in various colors by light irradiated from the rear side, and thus the panel assembly 30 or the panel 31 may be referred to as a screen.

The home appliance may be any one of a refrigerator 1, an air conditioner 5, a dishwasher 6, a clothes manager 7, a washing machine 8, or a cooking appliance 9, each of which has a front surface of which a color of an outer appearance is freely changed by applying the same structure as the panel assembly 30 according to an embodiment.

For example, in the above-described embodiment and in the refrigerator 1, the panel assembly 30 may be provided on a front side of the door 20 that opens and closes the cabinet 10. In addition, the panel assembly 30 may shine in a set color by user setting, and the outer appearance of the front surface of the refrigerator 1 may be changed in color.

As another example, an indoor unit of the air conditioner 5 may have a space in which a heat exchange device and a fan are provided inside a case 51 (or cabinet) that defines an outer appearance of the indoor unit. In addition, a front surface of the case 51 may be defined by a panel assembly 511. The panel assembly 511 may have the same structure as the panel assembly 30 of the refrigerator 1 to emit light.

Thus, the panel assembly 511 may shine in a set color by the user setting, and a color of the outer appearance of the front surface of the indoor unit of the air conditioner 5 may be changed into the set color.

As another example, in the dishwasher 6, a space for washing dishes may be defined inside a case 61 or a cabinet that defines an outer appearance of the dishwasher 6. In addition, the front surface of the case 61 may be opened and closed by the door 62, and the front surface of the door 62 may be defined by the panel assembly 621. The panel assembly 621 may have the same structure as the panel assembly 30 of the refrigerator 1 to emit light.

Thus, the panel assembly 621 may shine in a set color by the user setting, and a color of the outer appearance of the front surface of the dishwasher 6 may be changed into the set color.

As another example, in the clothes manager 7, a space for storing clothes may be defined inside a case 71 or a cabinet that defines an outer appearance of the clothes manager 7. In addition, the front surface of the case 71 may be opened and closed by the door 72, and the front surface of the door 72 may be defined by the panel assembly 721. The panel assembly 721 may have the same structure as the panel assembly 30 of the refrigerator 1 to emit light.

Thus, the panel assembly 721 may shine in a set color by the user setting, and a color of the outer appearance of the front surface of the clothes manager 7 may be changed into the set color.

As another example, in the washing machine 8 or a dryer, a space for washing or drying may be defined inside a case 81 (or cabinet) that defines an outer appearance of the washing machine 8. In addition, a front of the case 81 may be opened and closed by the door 82. The front surface of the case 81 may be defined by a panel assembly 811. The panel assembly 811 may have the same structure as the panel assembly 30 of the refrigerator 1 to emit light.

Thus, the panel assembly 30 may shine in a set color by the user setting, and a color of the outer appearance of the front surface of the washing machine 8, the dryer, or the air conditioner 5 may be changed into the set color.

As another example, in the cooking appliance 9, a space for cooking food may be defined inside a case 91 or a cabinet that defines an outer appearance of the cooking appliance. In addition, the front surface of the case 91 may be opened and closed by the door 92, and the front surface of the door 92 may be defined by the panel assembly 921. The panel assembly 921 may have the same structure as the panel assembly 30 of the refrigerator 1 to emit light.

Thus, the panel assembly 921 may shine in a set color by the user setting, and a color of the outer appearance of the front surface of the cooking appliance 9 may be changed into the set color.

A process of changing the color of the panel assembly 30 will be described below.

In a state in which the lighting device 36 is turned off, a color of the outer appearance of the front surface may be expressed by the color of the panel 31. A color displayed on the panel 31 in the state in which the lighting device 36 is turned off may be referred to as a first color.

When the lighting device 36 operates, the color of the panel 31 may be changed according to a color of light irradiated from the lighting device 36, and a color of the outer appearance of the front surface of the door 20 may be expressed in the selected color. In this case, the color of the light irradiated from the lighting device 36 may be referred to as a second color, and the color of the panel that is changed when the lighting device 36 is turned on may be referred to as a third color.

The second color may be different from the third color, and the third color of the panel 31 selected by the user may be implemented by the second color corrected in consideration of the first color of the panel 31 itself. That is, the light having the second color irradiated from the lighting device 36 may be determined by the controller 13 in consideration of the first color of the panel 31 itself, and the light having the second color may pass through the panel having the first color, and thus, the panel 31 may be finally expressed in the third color that is selected by the user.

In detail, the color of the panel 31 may be determined by a selective operation of the lighting device 36. For example, the lighting device 36 may also be manipulated and set through a remote device 2 spaced apart from the refrigerator 1. The refrigerator 1 may communicate with the remote device 2 through a communicator 17 connected to a controller 13, and the user may manipulate an operation of the lighting device 36 through the remote device 2.

The communicator 17 may communicate with the remote device 2 using various methods. The communicator 17 may communicate with the remote device 2 using various methods. The remote device 2 may be various devices that are capable of communicating, such as a dedicated terminal, a mobile phone, a tablet, a portable PC, a desktop PC, a remote control, or a Bluetooth speaker.

The user may manipulate and set the overall operation state of the lighting device 36, such as an operation time and an operation condition of the lighting device 36 and emission color through manipulation of the remote device 2. For example, the lighting device 36 may be simply manipulated and set through an application or a dedicated program installed in a portable phone of the user.

The selection of the color change of the panel 31 through the remote device 2 will be described with reference to FIG. 19. The user may select a desired color of the panel 31 through a screen 2*a* of the remote device 2 such as a mobile phone or a terminal.

When the user manipulates the remote device 2, the remote device first outputs a menu screen 2*b* and manipulates a panel color change menu 2*b*1 through the menu screen 2*b*.

When the user selects the panel color change menu 2*b*1, the remote device 2 may output a color selection screen 2*c* from the menu screen 2*b*, and the user may select a position of the panel 31 to be changed and the color of the panel 31 to be changed on the color selection screen.

In detail, a panel position selection menu 2*c*1 may be displayed on the color selection screen 2*c* to select the panel 31 mounted on the door 20 at a desired position among the plurality of doors 20. In addition, the panel 31 of the door 20 selected by the user may be displayed on the panel position selection menu 2*c*1.

After selecting the desired position of the panel 31, the user may select and input color selection menus 2*c*2 and 2*c*3 displayed on the color selection screen 2*c*, For example, in the color selection menus 2*c*2 and 2*c*3, all of the colors to be displayed by the panel 31 may be displayed in the form of a color picker capable of confirming and extracting a color code. The color selection menus 2*c*2 and 2*c*3 may be referred to as a palette because combinations and selection of various colors are possible.

The color selection menus 2*c*2 and 2*c*3 may include a circular first selection portion 2*c*2 and a bar-shaped second selection portion 2*c*3. The first selection portion 2*c*2 may select a color, and the second selection portion 2*c*3 may select an intensity of the selected color. The color selection menus 2*c*2 and 2*c*3 may include either one of the first selection portion 2*c*2 or the second selection portion 2*c*3.

As described above, the user may select the color of the panel 31, i.e., the third color, from among various colors through the color selection menus 2*c*2 and 2*c*3. Of course, the color selection menus 2*c*2 and 2*c*3 may be configured to be capable of being input in the form of letters, codes, and numbers.

In addition, according to the user's selection of the third color, the controller 13 may control the lighting device 36 to be turned on in the second color so that the panel 31 is displayed in the third color.

In addition, the user may input a color through a manipulation portion 14 provided in the refrigerator 1 without using the remote device 2.

In addition, each of the refrigerator 1 and the remote device 2 may be connected to a server in a network state, and thus, the color of the panel 31 of the refrigerator 1 may be input through the server 3.

The operation of the lighting device 36 may be performed by the manipulation of the manipulation portion 14 by the user. The manipulation portion 14 may be disposed at one side of the refrigerator 1, and for example, may be disposed at one side of the cabinet 10, As necessary, the manipulation portion 14 may be provided in the door 20, or the manipulation may be input by touching and manipulating the panel 31 such as knock. That is, the user may directly manipulate the manipulation portion 14 to set an operation of the lighting device 36 and may turn on or off the lighting device 36.

In addition, the lighting device 36 may also operate by a sensor. The sensor may be, for example, a user detection sensor 151 for detecting proximity of the user. For example, the user detection sensor 151 may use various devices for detecting user approaching near the refrigerator, such as an infrared sensor, an ultrasonic sensor, or a laser sensor.

The sensors 15 may be disposed at various positions for detecting proximity of the user, such as one side of the cabinet or one side of the door 20, and may be disposed at various positions for detecting proximity of the user. A plurality of sensors may be disposed at different positions.

Thus, when the user approaches the refrigerator 1 by a set distance for use of the refrigerator 1, the user detection sensor 151 may detect this and may transfer a signal to the controller 13 to turn on the lighting device 36. When the user moves away from the refrigerator 1, the user detection sensor 151 may detect this and may transfer a signal to the controller 13 to turn off the lighting device 36.

In detail, when the user detection sensor 151 detects that the user is very close to the refrigerator 1, the lighting device 36 may be turned off or the brightness may be gradually dimmed to prevent glare of the user. When the user moves away from the refrigerator 1 again, the lighting device 36 may be turned on again or may return to an original brightness.

The sensor may be an illumination sensor 152. The illumination sensor 152 may detect illumination of an indoor space and may be disposed at the same position as a position at which the user detection sensor 151 is disposed.

The lighting device 36 may be operated according to a detected illumination of the illumination sensor 152. For example, when the detected illumination of the illumination sensor 152 is equal to or less than a set illumination and the lighting device 36 is dimmed, the controller 13 may turn on the lighting device 36, and when the detected illumination of the illumination sensor 152 is equal to or greater than the set illumination and the lighting device 36 becomes brighter, the controller 13 may turn off the lighting device 36.

The sensor may include both the illumination sensor 152 and the user detection sensor 151, and the illumination sensor 152 and the user detection sensor 151 may be operated in a complex way to cause the controller 13 to turn off the lighting device 36.

The controller 13 may be connected to a microphone 18. Thus, the LED 362 may shine with set color according to a voice signal received from the microphone 18, and an input state of the voice signal or a setting state of a function may also be displayed through the front color of the door 20.

For example, when receiving a temperature control signal of the user through the microphone 18, the controller 13 may adjust a set temperature inside the refrigerator, and may operate the lighting device 36 to change color of the front surface of the door 20 to color corresponding to the corresponding temperature.

The lighting device 36 may be turned off at a time set by a timer 16. That is, the lighting device 36 may be turned on according to a time when the user is mainly active and may be maintained off outside the set time range. The lighting device 36 may be turned off during the day and on during night irrespective of actual illumination.

Irrespective of an operation state of the refrigerator 1, the brightness and color of the front surface of the door 20 may be adjusted only according to user settings.

The lighting device 36 may include the state in which brightness is adjusted in addition to an on state and an off state. That is, the controller 13 may control the output of the light irradiated through the lighting device 36 to change brightness of the panel 31. In addition, the operation state of the refrigerator 1 may be indicated through the brightness of the panel 31.

The operation state of the lighting device 36 operating by the controller 13 is now described. As shown in FIG. 19, when the lighting device 36 is turned on according to an instruction of the controller 13, light emitted from the LED 362 may be emitted toward the lower end of the light guide plate 33. In this case, the light emitted from the LED 362 may be irradiated with the second color selected by the controller 13. That is, the LED 362 may be an RGB LED and irradiates the light having the second color corrected by the controller 13 so that the surface of the panel 31 may shine in the third color selected by the user.

The light incident through the lower end of the light guide plate 33 may be diffused and reflected along the light guide plate 33 and then may move along the light guide plate 33. In this case, the light guided by the light guide plate 33 may be reflected forward by the reflective layer 331 to pass through the panel 31 so as to be transmitted to the outside.

Light directed forward through the light guide plate 33 may pass through the mounting member 32 to illuminate the panel 31, and the front surface of the door 20 may shine with a set brightness or color.

Here, the light guide plate 33 may irradiate light having sufficient brightness from the entire surface forward by the LED 362 disposed at each of both ends of an LED mounting portion 361*a*, and thus, the whole including both the ends of the panel 31 may shine with uniform brightness.

The lighting device 36 may be disposed at the lower end of the panel assembly 30 and may be fixed so as not to move inside the lower bracket 35. In addition, the light guide plate 33 is maintained in a fixed state by the mounting member 32. Thus, the light source 362 of the lighting device 36 and the lower end of the light guide plate 33 facing the light source 362 may be maintained to be aligned with each other to effectively irradiate the light of the light source 362 to the light guide plate 33.

Particularly, even when the door 20 is repeatedly opened and closed, the lighting device 36 and the light guide plate 33 may be maintained at accurate positions, and the panel 31 may be secured to shine with a set brightness.

In particular, the light guide plate 33 may be supported from below by its own weight, and thus the set interval G may be maintained between the lower end of the light guide plate 33 and the upper end of the light source 362. Thus, the light emitted from the light source 362 may be effectively incident on the lower end of the light guide plate 33, and the brightness of the panel 31 may be ensured and the panel 31 may shine with uniform brightness.

The lighting device 36 may be disposed below the upper end of the lower bracket bottom surface portion 354. Thus, viewed from the front, the lighting device 36 may be prevented from being exposed, and a lighting spot (a hot spot) may be prevented from being disposed adjacent to the light source 362, thereby improving the quality of an outer appearance of the front surface of the door 20 and preventing glare of the user.

Hereinafter, a change in outer appearance of the front surface of the door 20 according to the operation of the lighting device 36 will be described with reference to the drawings.

Figure 23:
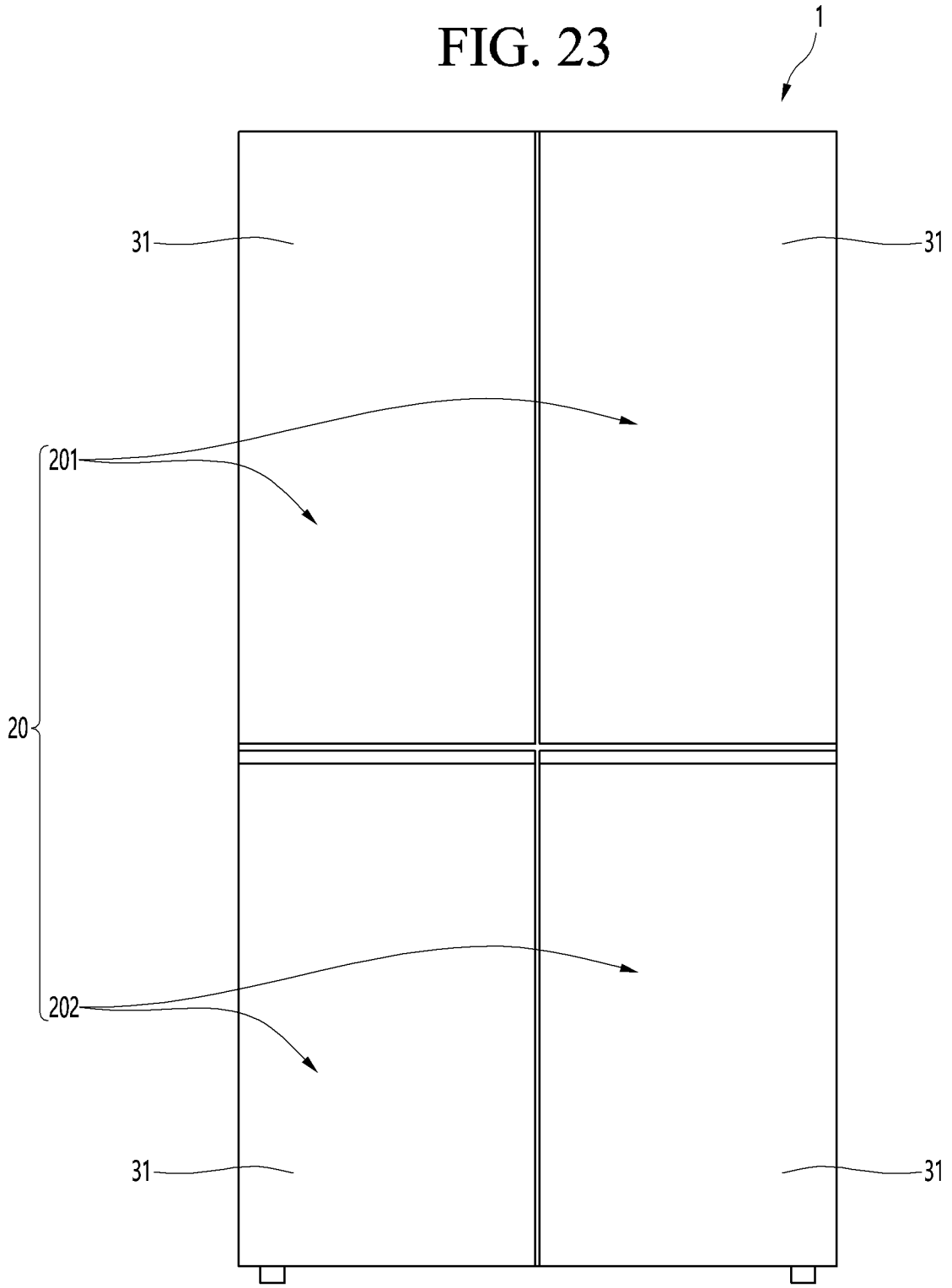
FIG. 23 is a front view illustrating an outer appearance of a front surface of the refrigerator that is in a state in which the lighting device is turned off.
Figure 24:
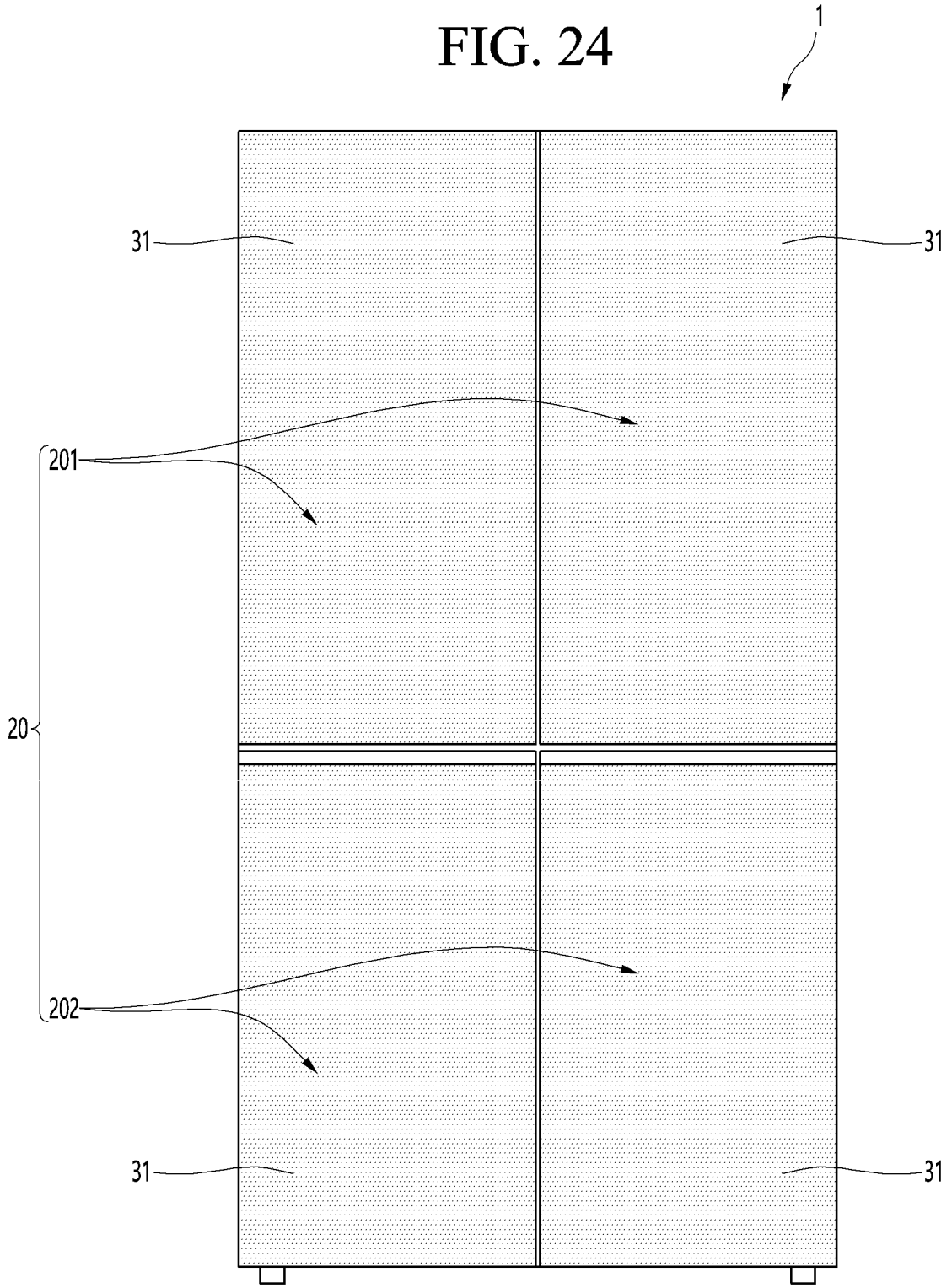
Figure 25:
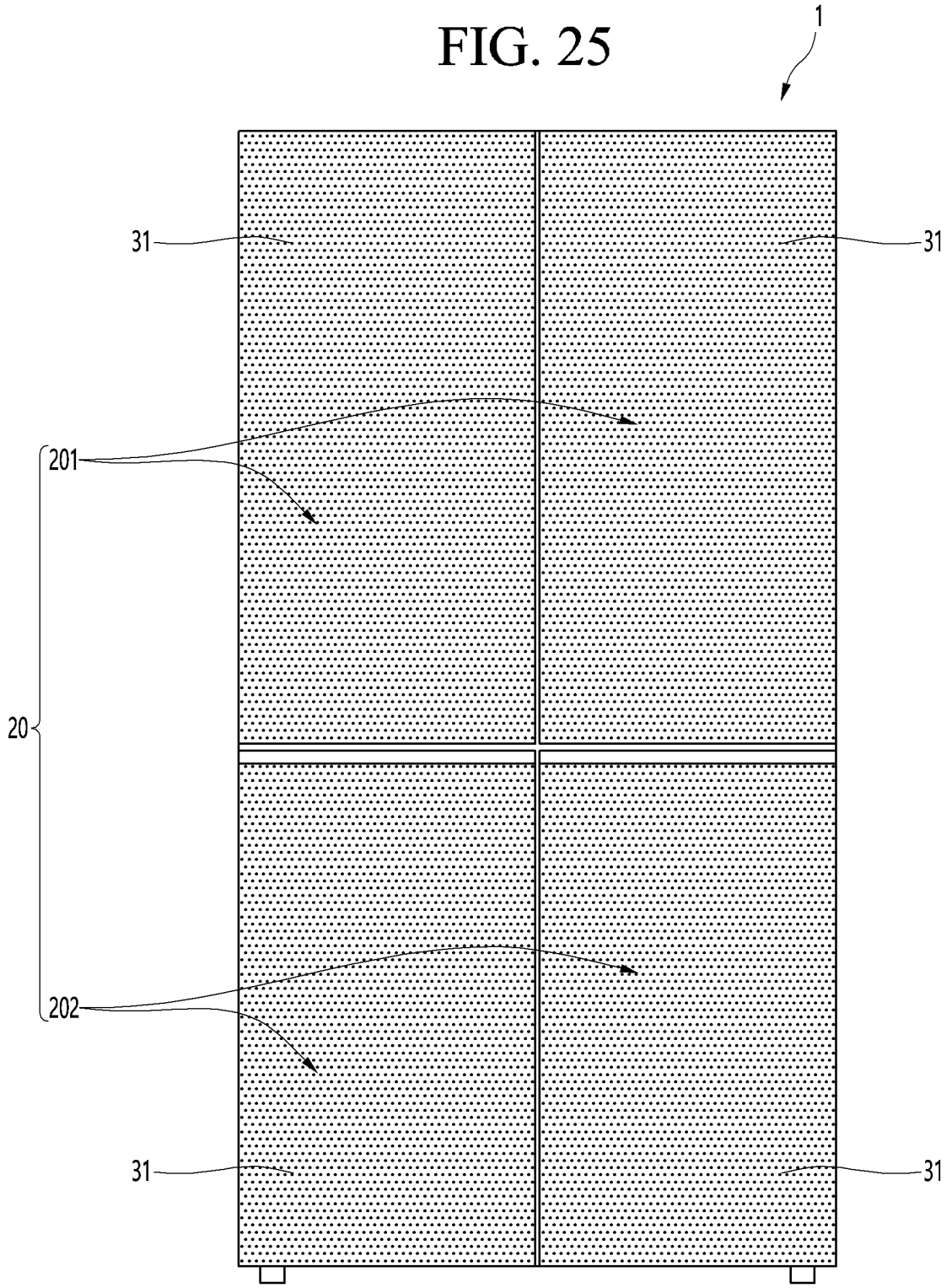
FIG. 25 is a front view illustrating an outer appearance of the front surface of the refrigerator in which the lighting device is changed in color.
Figure 26:
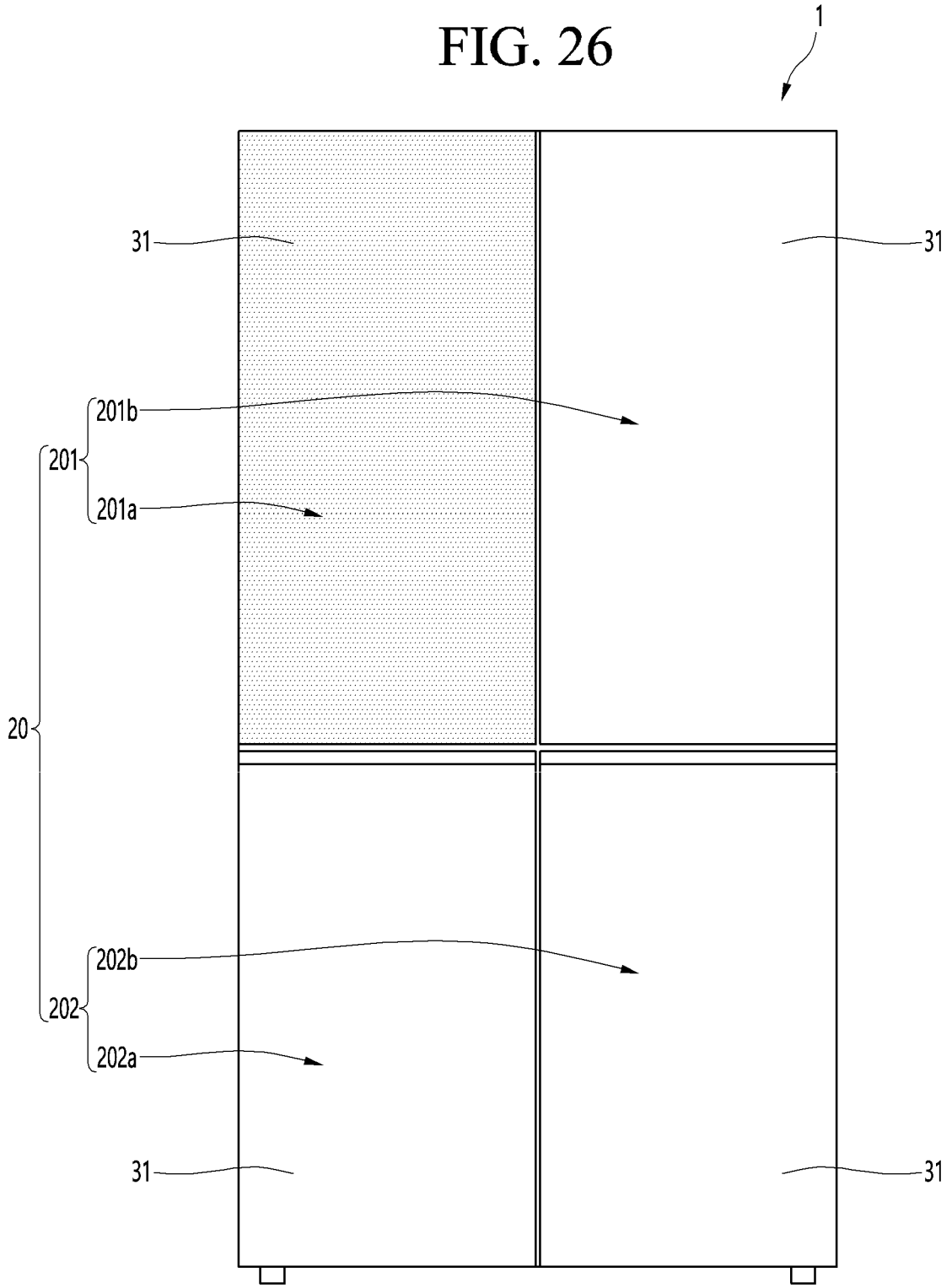
FIG. 26 is a front view illustrating an outer appearance of the front surface of the refrigerator in a state in which a portion of a plurality of doors emits light.
Figure 27:
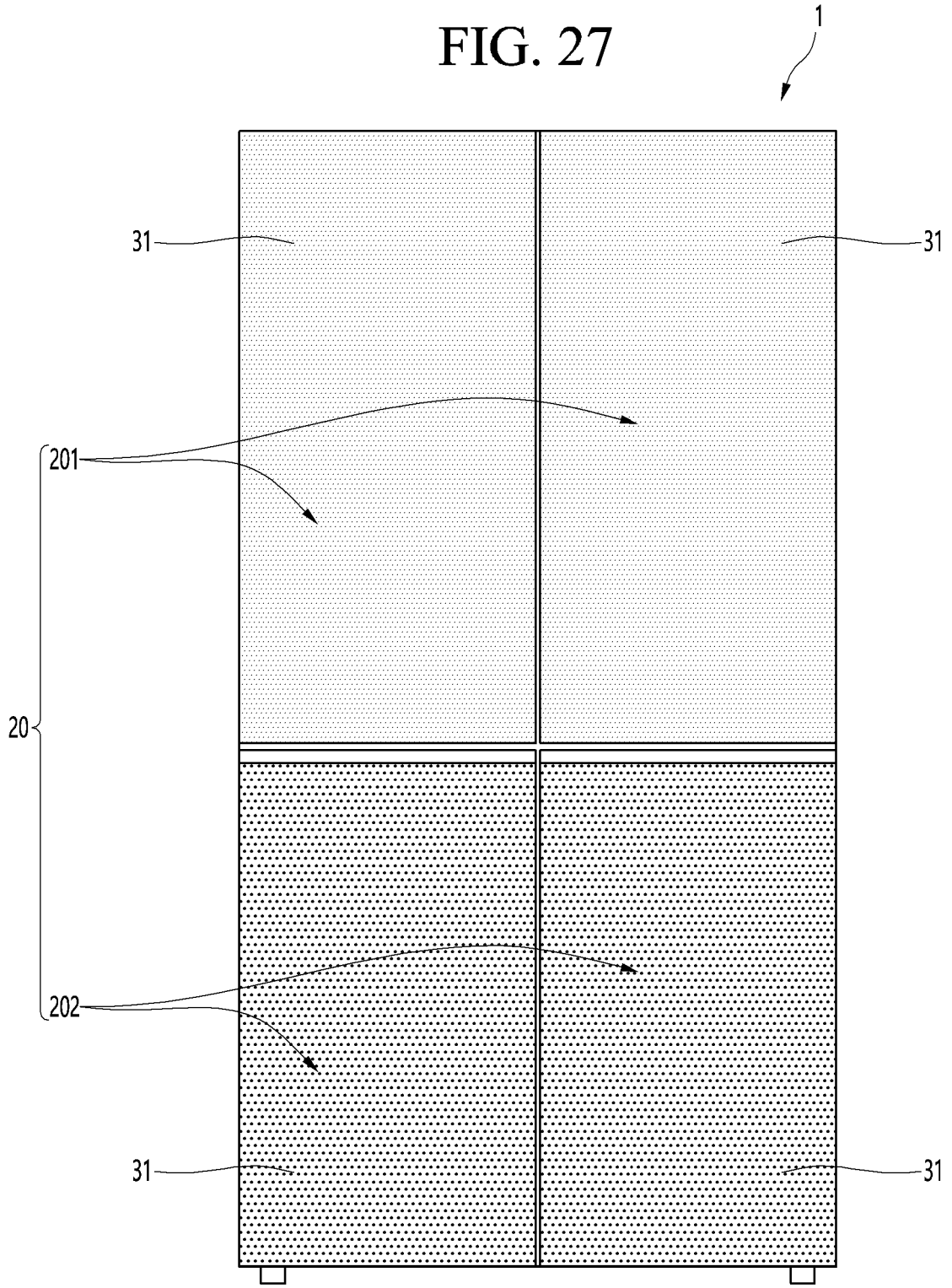
FIG. 27 is a front view illustrating the outer appearance of the front surface of the refrigerator in a state in which each of a refrigerating compartment door and a freezing compartment door of the doors emits light.

FIG. 23 is a front view illustrating an outer appearance of a front surface of the refrigerator that is in a state in which the lighting device is turned off. Also, FIG. 24 is a front view illustrating an outer appearance of a front surface of the refrigerator that is in a state in which the lighting device is turned on. Also, FIG. 25 is a front view illustrating an outer appearance of the front surface of the refrigerator in which the lighting device is changed in color. Also, FIG. 26 is a front view illustrating an outer appearance of the front surface of the refrigerator in a state in which a portion of a plurality of doors emits light. Also, FIG. 27 is a front view illustrating the outer appearance of the front surface of the refrigerator in a state in which each of a refrigerating compartment door and a freezing compartment door of the doors emits light.

For example, in the state in which the lighting device 36 is turned off, as illustrated in FIG. 23, a front surface of the door 20 may not shine, and an original color of the panel assembly 30 may appear.

The panel assembly 30 may have a structure that is separable from the door body 40, and thus, the user may select a color of the first panel 31 by mounting the panel assembly 30 having a desired color. Of course, if necessary, the user may change the color of the panel 31 when the lighting device 36 is turned off by exchanging the panel assembly 30 itself.

The color of the front surface of the door 20 may be seen as the color of the panel 31, and the texture and pattern provided on the panel 31 may be seen. In this case, the color of the panel 31 may be color with brightness greater than 0 and may be provided in a color other than black.

Thus, the front surface of the door 20 may be seen with the first color that is the color of the panel 31. In this case, components inside the panel assembly 30 may be seen through the panel 31 and may not be seen to the outside by the color of the panel 31.

In this state, the lighting device 36 may be turned on, and when the lighting device 36 is turned on, the front surface of the door 20 may shine with a color set by the user.

For example, as illustrated in FIG. 24, the controller 13 may control the front surface of the door 20 to shine with a second color different from the first color, and the lighting device 36 may cause the LED 362 to shine with the second color according to the control of the controller 13. Here, the third color may be selected by the user, and the color of the panel 31 may be selected by the manipulation of the remote device 2 or the manipulation of the manipulation portion 14.

When the LED 362 shines in the second color, the light reflected by the light guide plate 33 may pass through the front of the panel 31, and the front of the door 20, that is, the panel 31 may be expressed in the third color.

In the state in which the outer appearance of the front surface of the refrigerator 1 shines with the third color, when the controller 13 instructs change in color of the front surface of the refrigerator 1, the front surface of the panel 31 may shine with a color that is reset by the controller 13.

For example, as illustrated in FIG. 25, the controller 13 may instruct change in color of the front surface of the panel 31 to shine with the second color different from the first color, and the lighting device 36 may irradiate light having a color different from that of the LED 362 according to the instruction of the controller 13.

When the LED 362 shines in the different color, the light reflected by the light guide plate 33 may pass through the light through the panel 31, and the front of the door 20, that is, the panel 31 may be expressed in the fourth color.

Some of the plurality of doors 20 forming the outer appearance of the front surface of the refrigerator 1 may emit light, or the panels 31 constituting the plurality of doors 20 may independently emit light to define the outer appearance of the front surface of the refrigerator 1 with the set color.

For example, as illustrated in FIG. 24, the controller 13 may instruct change in color of the front surface of the door 20 to shine with the third color different from the first color and the second color, and the lighting device 36 may irradiate light having the different color through the lighting device 36.

When the light source 362 emits light having the different color, the light reflected by the light guide plate 33 may pass through the panel 31, and the front surface of the door 20, that is, the panel 31 may be expressed in the third color.

Some of the plurality of doors 20 forming the outer appearance of the front surface of the refrigerator 1 may emit light, or the panels 31 constituting the plurality of doors 20 may independently emit light to define the outer appearance of the front surface of the refrigerator 1 with the set color.

For example, as illustrated in FIG. 26, the refrigerator 1 may operate so that some doors 20 of the plurality of doors 20 shine or shine with a specific color. That is, all the lighting devices 36 provided in the doors 20 may not operate, but instead, only some doors 201*a* of all the doors 20 may shine. For example, any one door 201*a* of the refrigerating compartment door 201 may shine. That is, the left refrigerating compartment door 201*a* among the left refrigerating compartment door 201*a* and the right refrigerating compartment door 201*b* may shine. Of course, the door 20 may be any one of the freezing compartment doors 202.

As necessary, the left refrigerating compartment door 201*a* and the right refrigerating compartment door 201*b* may shine with a different color. At least two of the doors 20 may be sequentially changed in color and at least two of the doors 20 may be sequentially turned on or of.

The refrigerating compartment door 201 or the freezing compartment door 202 among the doors may be controlled to shine with the different color.

For example, as illustrated in FIG. 27, the controller 13 may control the lighting device 36 so that one pair of refrigerating compartment doors 201 are expressed in the first color. The controller 13 may control the lighting device 36 so that one pair of the refrigerating compartment doors 201 are expressed in a different color.

That is, the refrigerating compartment door 201 and the freezing compartment door 202 may be distinguished therebetween with colors, and according to a temperature change inside the refrigerator, the colors of the refrigerating compartment door 201 and the freezing compartment door 202 may also be changed.

Thus, through the front color of the door 20, the user may intuitively recognize an operation state of each storage space as well as may distinguish between the refrigeration compartment and the freezing compartment.

There may be various other embodiments other than the aforementioned embodiments. According to another embodiment of the present disclosure, the storage space may be partitioned into right and left sides, and the door includes a refrigerating compartment door and a freezing compartment door at right and left sides. Another embodiment of the present disclosure may have the same structure as the aforementioned embodiment except for arrangement of a storage space and a door, and thus the same components as in the aforementioned embodiment use the same reference numeral, and a detailed description thereof may be omitted.

Hereinafter, another embodiment of the present disclosure will be described with reference drawings.

Figure 28:
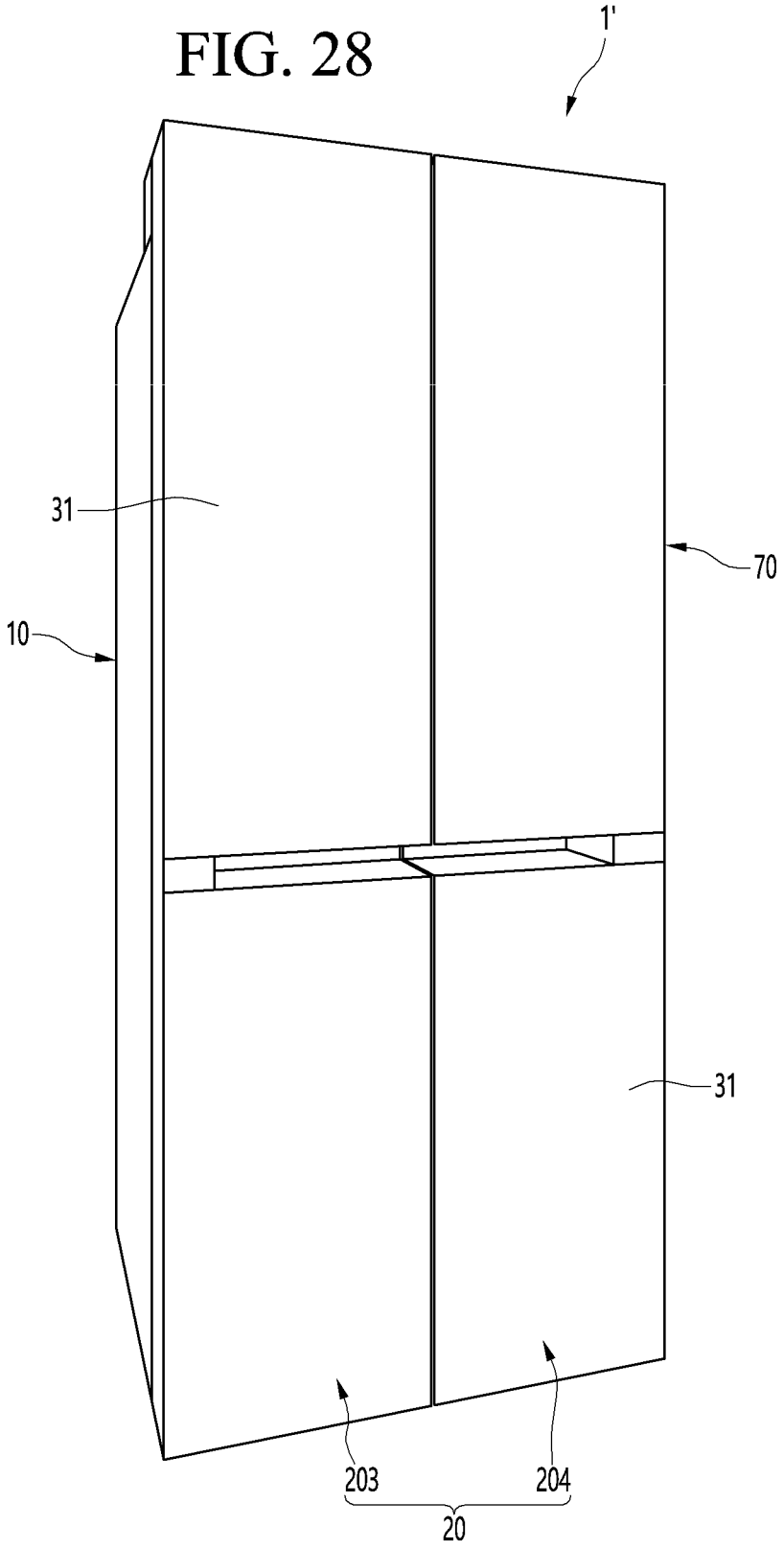
FIG. 28 is a perspective view of a refrigerator according to another embodiment.
Figure 29:
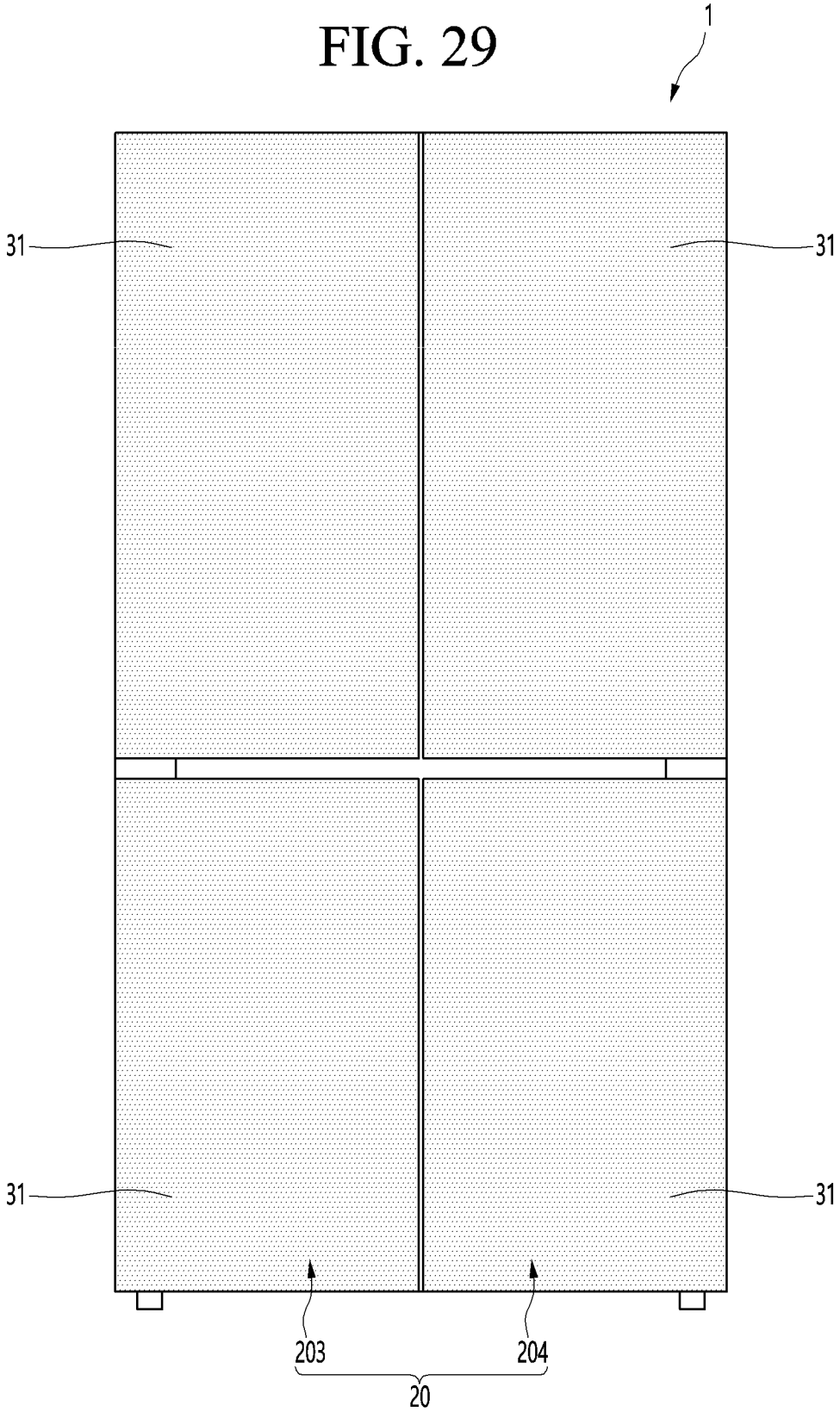

FIG. 28 is a perspective view of a refrigerator according to another embodiment. Also, FIG. 29 is a front view of a front appearance of a refrigerator in the state in which a lighting device of the refrigerator is turned on.

As shown in the drawings, an outer appearance of a refrigerator 1' according to another embodiment of the present disclosure may be defined by the cabinet 10 in which a storage space is defined, and the door 20 for opening and closing an open front surface of the cabinet 10.

The cabinet 10 may be divided into right and left sides. Although not shown, a left space of the cabinet 10 may be configured by a freezing compartment, and a right space of the cabinet 10 may be configured by a refrigerating compartment.

The door 20 may include a freezing compartment door 203 for opening and closing the freezing compartment and a refrigerating compartment door 204 for opening and closing the refrigerating compartment. The freezing compartment door 203 and the refrigerating compartment door 204 may be arranged in parallel to each other at right and left sides, and the refrigerating compartment and the freezing compartment may be configured to be opened and closed through rotation.

In the state in which the door 20 is closed, an outer appearance of the front surface of the refrigerator 1' may be defined by the door 20. The door 20 may include the door body 40 and the panel assembly 30. A detailed structure of the door 20 may be the same as the aforementioned embodiment and may be different therefrom except for the size and arrangement thereof, and thus a detailed description or illustration thereof may be omitted, and unexplained reference numerals in the drawings may refer to the aforementioned embodiment.

Color of the panel assembly 30 may be determined by the panel 31 configuring the front surface of the panel assembly 30. Thus, in the state in which the lighting device is turned off, the outer appearance of the front surface of the refrigerator 1' may be defined by color of the panel itself.

When the lighting device 36 is turned on under control of the controller 13, light emitted by the lighting device 36 may be seen through the panel 31 to change the panel 31 in color or brightness. In this case, under control of the controller 13, the lighting device 36 may emit light with various colors, and the panel 31 may be changed to various colors to shine. That is, in the state in which the door 20 is maintained to be assembled and mounted, color or brightness of the outer appearance of the front surface of the refrigerator 1' may be changed resulting in change in the outer appearance of the front surface.

As necessary, the refrigerating compartment door 204 and the freezing compartment door 203 may shine with different colors, and the refrigerating compartment door 204 and the freezing compartment door 203 may shine with color selected to harmonize with surrounding furniture or an installation environment to harmonize with a surrounding environment. When an installation or usage environment or a usage condition is change, the outer appearance of the front surface of the refrigerator 1' may be freely changed according to the change.

The home appliance according to the proposed embodiments may have the following effects.

According to the embodiments, the panel assembly may be provided with the panel holder protruding backward from both the left and right ends of the rear surface thereof, and the holder case in which the panel holder are inserted and restricted may be disposed on the front surface of the door body. Thus, the panel assembly may move forward and backward to attach and detach the panel assembly from/to the door body, thereby improving the assembly and mounting operations.

In addition, the panel holder may be provided in plurality along both the left and right ends of the panel assembly, and the holder case may be provided in plurality along both the left and right ends of the door body. Thus, both the left and right ends of the panel assembly may be maintained in the state of being firmly coupled to both the sides of the door body without being lifted, thereby improving the outer appearance. In particular, when the panel assembly has the long length in the vertical direction, the more stable mounting structure may be provided, and the improvement of the quality of the outer appearance may be secured.

In addition, the upper protrusion and the lower protrusion, which protrude backward, may be disposed on the upper and lower ends of the panel assembly and then be fixed to the door body. Both the left and right ends of the panel assembly may be fixed to the door body by coupling the panel holder and the holder case. Thus, the entire circumference of the upper, lower, left, and right sides of the door panel assembly may be coupled to the door body, and the firm and stable mounting between the door panel assembly and the door may be secured.

In particular, even when the panel assembly has the heavy weight and large size, the sagging or partial lifting may be prevented from occurring, and even when the door is repeatedly opened and closed, the movement and detachment of the panel assembly may be prevented from occurring.

In addition, the coupling structure may be distributed at the upper, lower, left, and tight ends of the panel assembly so as to be maintained in the overall restriction state of the panel assembly, and the load of the panel assembly may be distributed, and thus, the more stable mounting state may be maintained.

In addition, the panel holder may have the structure which is primarily fixed by inserting one end of the panel holder into the mounting member and is secondarily fixed to the back cover through the screw, and thus, the panel holder may be more firmly fixed. In addition, there may be the advantage in that the stable mounting is corrected even when the panel assembly is heavy due to the firm fixing structure.

In addition, to separate and mount the panel assembly, the panel assembly may move in the forward and backward direction after the screw of the lower end is separated, and thus, the panel assembly may be easily separated from and mounted on the door body. Thus, there may be the advantage in that the assemblability is improved, and the maintenance is easy.

In addition, the panel holder may have the structure that is inserted and fixed through the opening of the front surface of the door body, and the rear surface of the panel assembly may be in close contact with the front surface of the door body. Thus, there may be the advantage in that the increase of the overall thickness of the door is prevented, and the coupling structure with the door is sufficiently secured while maintaining the thickness of the door.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An appliance comprising:

a cabinet that defines a storage space; and a door configured to open and close at least a portion of the storage space, the door comprising a door body and a panel assembly that is disposed on a front surface of the door body, wherein the panel assembly comprises:

a lighting device configured to output light, a panel that defines a front surface of the door and is configured to transmit the light with a set color, a back cover that defines a rear surface of the panel assembly, and a panel holder that fixes the panel assembly to the door body, and wherein the panel holder comprises:

a base that is fixed to an inside of the panel assembly, and a holder protrusion that protrudes from the base, the holder protrusion passing through the back cover and being coupled to the door body.

2. The appliance according to claim 1, wherein the panel assembly further comprises:

a light guide plate disposed rearward relative to the panel and configured to guide the light emitted from the lighting device; and a mounting member that accommodates ends of the light guide plate and faces the panel holder.

3. The appliance according to claim 2, wherein the base is in contact with a rear surface of the light guide plate.

4. The appliance according to claim 3, wherein the base and the light guide plate are inserted into the mounting member.

5. The appliance according to claim 2, wherein the base comprises:

a base insertion portion inserted into the mounting member; and a base exposed portion that is exposed to an outside of the mounting member, and wherein the holder protrusion is disposed at the base exposed portion.

6. The appliance according to claim 5, wherein the base further comprises a base stepped portion that defines a boundary between the base insertion portion and the base exposed portion, the base stepped portion being in contact with an end of the mounting member.

7. The appliance according to claim 6, wherein the mounting member defines a holder restriction groove that is recessed from an end of the mounting member toward one of the ends of the light guide plate, and wherein the base further comprises a holder restriction protrusion disposed at the base stepped portion and inserted to the holder restriction groove.

8. The appliance according to claim 2, wherein the mounting member comprises:

a front surface portion that is disposed between the panel and the light guide plate and supports the panel; and a side surface portion that extends rearward from an end of the front surface portion and is coupled to one of the ends of the light guide plate, and wherein the base is disposed at the side surface portion.

9. The appliance according to claim 8, wherein the side surface portion comprises:

a first part that extends rearward from the end of the front surface portion and defines a side surface of the panel assembly; and a second part that extends laterally inward from an end of the first part to thereby define a space that accommodates the light guide plate and the panel holder.

10. The appliance according to claim 9, wherein the side surface portion further comprises a third part that is disposed between the first part and the second part and defines a step between the first part and the second part, wherein the mounting member defines:

a first insertion space that receives the light guide plate at a position between the front surface portion and the third part, and a second insertion space that receives the base at a position between the second part and the third part.

11. The appliance according to claim 10, wherein the second insertion space has an upper end and a lower end that define openings, respectively, and wherein the panel assembly further comprises:

an upper bracket that defines a top surface of the panel assembly and is inserted into the upper end of the second insertion space, and a lower bracket that defines a bottom surface of the panel assembly and is inserted into the lower end of the second insertion space.

12. The appliance according to claim 2, wherein the panel assembly further comprises:

an upper bracket that defines a top surface of the panel assembly and is disposed at an upper end of the mounting member; and a lower bracket that defines a bottom surface of the panel assembly and is disposed at a lower end of the mounting member.

13. The appliance according to claim 12, wherein the panel holder is one of a plurality of panel holders that are disposed between the upper bracket and the lower bracket and arranged along the mounting member.

14. The appliance according to claim 13, wherein the upper bracket comprises an upper protrusion coupled to the door body, and wherein the lower bracket comprises a lower protrusion coupled to the door body.

15. The appliance according to claim 2, wherein the back cover comprises:

a cover protrusion that protrudes forward and supports a rear side of the light guide plate; and a cover circumferential portion disposed along a circumference of the cover protrusion and supported on the mounting member, and wherein the panel holder passes through the cover circumferential portion of the back cover and protrudes toward the door body.

16. The appliance according to claim 1, wherein the holder protrusion comprises:

a holder extension portion that extends from the base; and a holder hook portion disposed at an end of the holder extension portion and coupled to an inside of the door body, and wherein a thickness of the holder hook portion is greater than a thickness of the holder extension portion.

17. The appliance according to claim 1, wherein the panel holder further comprises:

an upper boss disposed at the base above the holder protrusion;

a lower boss disposed at the base below the holder protrusion;

an upper screw that passes through the back cover and is coupled to the upper boss to thereby restrict movement of the panel holder; and a lower screw that passes through the back cover and is coupled to the lower boss to thereby restrict movement of the panel holder.

18. The appliance according to claim 1, wherein the front surface of the door body defines a plate opening that receives the panel holder, and wherein the door body comprises a holder case that is disposed inside the door body and coupled to an end of the panel holder inserted through the plate opening.

19. The appliance according to claim 18, wherein the holder case comprises:

a case body that defines a front surface of the holder case and is in contact with the door body, the case body defining a holder accommodation portion recessed into the case body; and a pair of case restriction portions that protrude from an inside of the case body toward the back cover, and wherein the pair of case restriction portions are spaced apart from each other and receive the holder protrusion therebetween.

20. The appliance according to claim 19, wherein the door body comprises:

a body plate that defines the front surface of the door body; and a side decoration that defines a left surface of the door body or a right surface of the door body, and wherein the holder case is coupled to the body plate and the side decoration.

* * * * *